US009759038B2

(12) United States Patent
McGeoch et al.

(10) Patent No.: US 9,759,038 B2
(45) Date of Patent: Sep. 12, 2017

(54) DOWNHOLE TOOL AND METHOD

(71) Applicant: Petrowell Limited, Aberdeen (GB)

(72) Inventors: Andrew McGeoch, Aberdeen (GB); Liam Watt Clark Goodall, Midlothian (GB); Sean Stewart, Aberdeen (GB); John Sladic, Aberdeen (GB); Shawn Rabel, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 210 days.

(21) Appl. No.: 14/081,665

(22) Filed: Nov. 15, 2013

(65) Prior Publication Data

US 2014/0224504 A1 Aug. 14, 2014

Related U.S. Application Data

(63) Continuation-in-part of application No. 13/956,660, filed on Aug. 1, 2013.

(30) Foreign Application Priority Data

Feb. 8, 2013 (GB) ..... 1302308.0

(51) Int. Cl.

| | |
|---|---|
| ***E21B 34/06*** | (2006.01) |
| ***E21B 34/14*** | (2006.01) |
| ***E21B 43/26*** | (2006.01) |
| ***E21B 43/08*** | (2006.01) |
| ***E21B 43/12*** | (2006.01) |
| *E21B 34/00* | (2006.01) |

(52) U.S. Cl.
CPC ..... *E21B 34/06* (2013.01); *E21B 34/14* (2013.01); *E21B 43/08* (2013.01); *E21B 43/12* (2013.01); *E21B 43/26* (2013.01); *E21B 2034/007* (2013.01)

(58) Field of Classification Search
USPC ..... 166/373, 205
See application file for complete search history.

(56) References Cited

U.S. PATENT DOCUMENTS

| | | | |
|---|---|---|---|
| 5,636,691 | A | 6/1997 | Hendrickson et al. |
| 5,730,223 | A | 3/1998 | Restarick |
| 6,220,357 | B1 | 4/2001 | Carmichael et al. |

(Continued)

FOREIGN PATENT DOCUMENTS

| | | | |
|---|---|---|---|
| GB | 2492193 | A | 12/2012 |

OTHER PUBLICATIONS

Invitation to Pay Additional Fees with Partial International Search Report received in corresponding PCT Application PCT/GB2014/050338 dated Dec. 22, 2014.

(Continued)

*Primary Examiner* — Taras P Bemko
(74) *Attorney, Agent, or Firm* — Blank Rome LLP

(57) ABSTRACT

A downhole tool (10) and method for controlling fluid flow into and/or from a formation zone (FZ), the downhole tool (10) comprising a sliding sleeve device (12) disposed between, and forming a fluid coupling between a first screen (14) and a second screen (16), the sliding sleeve device (12) configured to provide axial fluid communication between the screens (14, 16) and to provide selective lateral passage of fluid through the screens (14, 16) into a throughbore (24,36,42) of the downhole tool (10).

22 Claims, 18 Drawing Sheets

(56) References Cited

U.S. PATENT DOCUMENTS

| | | | | |
|---|---|---|---|---|
| 6,318,465 | B1 | 11/2001 | Coon et al. | |
| 6,405,800 | B1 | 6/2002 | Walker et al. | |
| 6,491,097 | B1 | 12/2002 | Oneal et al. | |
| 7,503,384 | B2 | 3/2009 | Coronado | |
| 8,017,847 | B1 | 9/2011 | Chuang | |
| 8,245,789 | B2 | 8/2012 | Holderman et al. | |
| 2002/0157837 | A1 | 10/2002 | Bode et al. | |
| 2004/0035578 | A1 | 2/2004 | Ross et al. | |
| 2004/0244976 | A1 | 12/2004 | Turner et al. | |
| 2006/0118296 | A1* | 6/2006 | Dybevik | E21B 17/18 166/242.1 |
| 2008/0142218 | A1* | 6/2008 | Rytlewski | E21B 34/10 166/278 |
| 2009/0084553 | A1 | 4/2009 | Rytlewski et al. | |
| 2009/0159264 | A1* | 6/2009 | Turner | E21B 34/14 166/113 |
| 2009/0223362 | A1* | 9/2009 | Farrar | E21B 23/04 92/116 |
| 2013/0008652 | A1 | 1/2013 | Broussard et al. | |

OTHER PUBLICATIONS

Examination Report in counterpart EP Appl. 14705859.8, dated Jun. 1, 2017, 6-pgs.

* cited by examiner

DOWNHOLE TOOL AND METHOD

FIELD OF THE INVENTION

This invention relates to a downhole tool and method. More particularly, but not exclusively, embodiments of the invention relate to a downhole tool for controlling fluid flow into and/or from a formation, such as a hydrocarbon bearing formation.

BACKGROUND OF THE INVENTION

In the oil and gas exploration and production industry, well boreholes are drilled in order to access subsurface hydrocarbon-bearing formations. The drilled borehole may then be lined with sections of bore-lining tubing, known as casing or liner, which is then secured in place, typically using cement. A completion string may then be run into the borehole and operable to perform a number of different operations. For example, in some instances a formation may be susceptible to ingress of particulate matter, such as sand or the like, which if unabated can result in significant damage to equipment and tools and may also result in significantly decreased production from a particular formation zone. In order to combat the ingress of particulate matter, the completion string may be utilised to perform a gravel packing operation and/or to locate sand screens comprising filter media wrapped around a perforated base pipe and which permit the flow of fluid for extraction but prevent the passage of particulates.

More recently, "frac-pack" techniques have been developed which combines a hydraulic fracturing or "fracking" operation and a packing operation. The hydraulic fracturing operation involves the controlled injection of fluid into the formation to propagate fractures in the formation rock and increase flow of hydrocarbons for extraction while the packing operation involves the location of a packing material in the fractures and in the annulus between the completion string and the borehole wall for particulate control.

While frac-packing provides benefits in terms of increased production and reduced impact of particulate ingress, conventional frac-pack techniques and equipment still have a number of drawbacks. For example, completion strings are becoming ever more complex with the various completion string tools, handling areas, centralisers and couplings limiting the flow area available for production, reducing the utility of the formation. Moreover, in order to direct fluid into the formation when carrying out the fracturing operation the sand screens must be isolated so that the fluid being injected into the formation does not flow directly through them back into the completion string. This may be done by isolating the fluid return path at surface. By contrast, in order to avoid unpacked areas a return flow path is necessary during the packing operation so that the packing material—in the case of a frac-pack operation proppant—can be dehydrated from the residual carrier fluid and fill the annulus between the outside of the sand screens and the borehole. Also, during subsequent operations, such as hydrocarbon production or water injection, high rate fluid transfer through the sand screens is necessary so that the production or injection fluids can flow between the reservoir and the completion.

SUMMARY OF THE INVENTION

Aspects of the present invention relate to the control of fluid flow into and/or from a formation zone.

According to a first aspect of the present invention there is provided a downhole tool comprising:

a screen; and a flow control apparatus or arrangement configured to prevent passage of fluid through the screen.

The flow control apparatus or arrangement may be configured to prevent the direct passage of the fluid through the screen. For example, the flow control apparatus or arrangement may be configured to provide a fluid flow path for directing the fluid to a port. In use, the flow control apparatus or arrangement may be configured to provide a fluid flow path for directing the fluid to a port for returning the fluid to surface or other remote location.

The flow control apparatus or arrangement may be configured to selectively prevent passage of the fluid through the screen. The flow control device or arrangement may be configured to prevent or selectively prevent passage of the fluid from an outer side of the screen to an inner side of the screen.

The downhole tool may comprise a plurality of the screens.

The downhole arrangement may be configurable for at least one of fluid injection, stimulation, fracturing and production.

Where the downhole tool comprises a plurality of screens, the flow control apparatus or arrangement may be disposed between adjacent screens. In use, the flow control apparatus or arrangement may provide fluid communication between the adjacent screens. The flow control apparatus or arrangement may be configured to provide a fluid coupling between a plurality of the screens, for example a plurality of screens associated with a given formation zone. The flow control apparatus or arrangement may be configured to provide axial fluid communication between the screens. The flow control apparatus or arrangement may be configured to provide selective lateral passage of fluid through the screens into a throughbore of the downhole tool.

Beneficially, the flow control apparatus or arrangement may be configured to provide a fluid flow path for directing the fluid from a plurality of screens, for example all screens operatively associated with a given formation zone, to the port.

The flow control device or arrangement may be configured for coupling to the screen. The flow control device or arrangement may be configured for coupling to the screen by a threaded connection, weld, quick connect device or other suitable coupling.

Where the downhole tool comprises a plurality of screens, the flow control apparatus or arrangement may comprise a coupling and the screen or screens may be coupled to the flow control apparatus or arrangement. Beneficially, by using the flow control apparatus or arrangement as a coupling between screens, the area of screen available for passage of fluid may be increased.

The screen may be of any suitable form and construction.

The screen may comprise a first tubular.

The first tubular may comprise a permeable member.

The screen may comprise a second tubular.

The second tubular may comprise a non-permeable member. The second tubular may comprise a solid tubular member. The second tubular may comprise a base pipe, production tubing, carrier tube or the like.

The second tubular may be disposed within the first tubular. Beneficially, the provision of a non-permeable second tubular prevents or assists in preventing the direct passage of the fluid through the screen.

The second tubular may define an axial throughbore. In use, the flow control apparatus or arrangement may be configured to prevent or selectively prevent passage of fluid into the axial throughbore of the screen.

An annulus may be provided between the first tubular and the second tubular. The flow control apparatus or arrangement may be configured to provide a fluid flow path for directing the fluid disposed in the annulus to the port. In particular embodiments, the flow control apparatus or arrangement may be configured to provide a fluid flow path for directing the fluid disposed in the annulus of a plurality of screens, for example all screens operatively associated with a given formation zone, to the port.

The screen may comprise a filter screen layer.

The screen may comprise a sand screen or the like.

The flow control apparatus or arrangement may comprise a sleeve.

The flow control device or arrangement may comprise a plurality of sleeves.

Where a plurality of sleeves are provided, the sleeves may be axially spaced.

The, or each, sleeve may comprise a lateral flow passage. One or more sleeve may comprise a plurality of lateral flow passages. In use, the sleeve may be configured to selectively prevent passage of fluid through the flow passage.

The downhole tool may comprise a first sleeve, which may comprise a sliding sleeve device. The first sleeve may comprise an injection and/or production sleeve of the downhole tool.

The first sleeve may comprise a mandrel. The mandrel may comprise a tubular member defining an axial throughbore. The mandrel may be configured to be coupled at its uphole end to the second tubular of a first screen. The mandrel may be configured to be coupled at its downhole end to the second tubular of a second screen. The lateral flow passage or passages may be disposed in the mandrel.

The first sleeve may comprise a housing. The housing may be configured to be coupled at its uphole end to an end ring of a first screen. The housing may be configured to be coupled at its downhole end to an end ring of a second screen.

The first sleeve may comprise an annulus between the mandrel and the housing.

The first sleeve may comprise a sliding sleeve member or closure member. The sliding sleeve member may be slidably disposed within the mandrel. In use, the sliding sleeve member may be configured to open and close the lateral flow passage or passages of the first sleeve The downhole tool may comprise a second sleeve, which may comprise a sliding sleeve device. The second sleeve may comprise an injection and/or production sleeve of the downhole tool.

The second sleeve may comprise a mandrel. The second sleeve may comprise one or more lateral flow passage. The mandrel may comprise a tubular member defining an axial throughbore. The mandrel may be configured to be coupled at its downhole end to the uphole end of a first screen.

The second sleeve may comprise a housing. The housing may be configured to be coupled at its downhole end to an upper end ring of the first screen. The second sleeve may comprise an annulus between the mandrel and the housing.

The second sleeve may comprise a sliding sleeve member or closure member. The sliding sleeve member may be slidably disposed within the mandrel. In use, the sliding sleeve member may be configured to open and close the lateral flow passage or passages of the second sleeve.

The downhole tool may comprise a third sleeve, which may comprise a sliding sleeve device. The third sleeve may comprise an injection and/or production sleeve of the downhole tool.

The third sleeve may be disposed at a downhole end of the second screen. The third sleeve may comprise an injection sleeve, in particular embodiments a high volume injection sleeve. The third sleeve may comprise a mandrel. The third sleeve may comprise one or more lateral flow passage. The third sleeve may comprise a housing. The mandrel may comprise a tubular member defining an axial throughbore. The mandrel may be configured to be coupled at its uphole end to the downhole end of the second tubular of the second screen. The housing may be configured to be coupled at its uphole end to a lower end ring of the second sleeve. The third sleeve may comprise an annulus between the mandrel and the housing. The third sleeve may comprise a sliding sleeve member or closure member. The sliding sleeve member may be slidably disposed within the mandrel. In use, the sliding sleeve member may be configured to open and close the lateral flow passage or passages of the third sleeve.

The downhole tool may comprise a fourth sleeve, which may comprise a sliding sleeve device. The fourth sleeve may comprise a return sleeve of the downhole tool.

The fourth sleeve may be disposed at a downhole end of the third sleeve.

The fourth sleeve may comprise a mandrel. The fourth sleeve may comprise one or more lateral flow passage. The mandrel may comprise a tubular member defining an axial throughbore. The mandrel may be configured to be coupled at its uphole end to a downhole end of the mandrel of the third sleeve.

The third sleeve may comprise a housing. The housing may be configured to be coupled at its uphole end to the housing of the third sleeve.

The fourth sleeve may comprise an annulus between the mandrel and the housing.

The fourth sleeve may comprise a sliding sleeve member or closure member. The sliding sleeve member may be slidably disposed within the mandrel. In use, the sliding sleeve member may be configured to open and close the lateral flow passage or passages of the fourth sleeve.

The downhole tool may comprise a fifth sleeve, which may comprise a sliding sleeve device. The fifth sleeve may comprise a fracture sleeve of the downhole tool.

The fifth sleeve may be disposed at an uphole end of the second sleeve.

The fifth sleeve may comprise a mandrel. The mandrel may comprise one or more lateral flow passage. The mandrel may comprise a tubular member defining an axial throughbore. The mandrel may be configured to be coupled at its downhole end to the uphole end of the mandrel of the second sleeve.

The fifth sleeve may comprise a sliding sleeve member or closure member. The sliding sleeve member may be slidably disposed within the mandrel. In use, the sliding sleeve member may be configured to open and close the lateral flow passage or passages of the fifth sleeve.

At least one sleeve may be actuated mechanically. For example, the sleeve may be actuated by a setting tool, shifting tool or the like. The shifting tool may be deployed on drill pipe. The shifting tool may be deployed on wash pipe. The shifting tool may be deployed on wireline. The shifting tool may be deployed on coiled tubing.

The plurality of primary electromagnetic elements may be connected electrically in parallel.

Alternatively, or additionally, at least one sleeve may be fluid actuated. For example, at least one sleeve may be hydraulically actuated.

At least one sleeve may be actuated from surface.

At least one sleeve may be actuated downhole. In some embodiments, at least one sleeve may be actuated by a downhole pump activated through a signal received through Radio Frequency Identification (RFID), pressure pulse signature means or the like.

The fluid may comprise a well treatment medium.

The fluid may comprise a fracturing medium.

The fluid may comprise a packing medium.

The fluid may comprise at least one of a proppant and a carrier.

The downhole tool may comprise a tool for treating a wellbore.

The string may comprise a completion string. The string may comprise a running string, drill string or the like.

The downhole tool may comprise or provided in combination with at least one packer.

Accordingly, embodiments of the present invention provide, amongst other things, a means of opening and closing the flow path to the inner diameter of the downhole tool and to any associated components such as other components of a completion string for injection or production purposes; a path for fluid to flow through the filter media and between any and all sand screens across a zone to a single return port, for example at its base, for re-entry; the ability to open all sand screens to flow following the completion of a frac-pack operation; a wide open flow area; and/or a flow path across the outside of the connection between sand screen joints without a requirement for ports in the base pipe of either screen joint.

The frac-pack operation may be conducted on each reservoir zone individually. At the top of each zone a frac port may provide a location for proppant slurry to exit the service tool and reservoir completion and enter the reservoir section, at the base of each zone a return point may provide a location for residual carrier fluid to re-enter the completion and service tools from the reservoir section.

The downhole tool may comprise a flow restrictor.

The flow restrictor may be configured or arranged to alter the fluid dynamics of a fluid flow through the downhole tool. The flow restrictor may be configured to alter the pressure of the fluid flow through the downhole tool. More particularly, the flow restrictor may be configured to reduce the pressure of a fluid flow through the downhole tool.

The flow restrictor may be positioned to alter the pressure of the fluid flow at a selected location or locations in the downhole tool, for example to alter the pressure of the fluid flow at a location or location most susceptible to erosion.

Beneficially, the provision of a flow restrictor may restrict the flow of fluid to eliminate, mitigate or control erosion in the downhole tool. For example, the flow restrictor may be configured and/or arranged to preferentially control the location at which erosion occurs. In particular embodiments, the flow restrictor may be configured to preferentially move the position at which erosion occurs or is expected to occur to a location distal to the port or other location where the direction of fluid flow changes. The flow restrictor may thus eliminate, mitigate or control erosion which may otherwise occur in a sleeve, such as a sleeve described above, where the fluid flow changes direction, such as where the fluid flow passes from the throughbore into the sleeve annulus.

The flow restrictor may be disposed in a sleeve. For example, the flow restrictor may be disposed in at least one of the first sleeve device, second sleeve device, third sleeve device, fourth sliding sleeve device or fifth sleeve device.

The flow restrictor may be disposed in a sleeve annulus, such as the annulus of first sleeve device, second sleeve device, third sleeve device, fourth sliding sleeve device or fifth sleeve device.

The flow restrictor may be configured or arranged to alter the fluid dynamics of the fluid flow through the sleeve annulus.

Beneficially, the provision of a flow restrictor restricts the flow of fluid through the sleeve annulus and alters the flow dynamics to preferentially move the location at which erosion may occur, such as where the fluid flow changes direction on exiting the port, to mitigate, control or eliminate damage to the sleeve.

The flow restrictor may be of any suitable form and construction.

The flow restrictor may be disposed or formed in the sleeve annulus.

The flow restrictor may be integrally formed in the sleeve annulus.

In particular embodiments, however, the flow restrictor may comprise a separate component secured in the annulus.

The flow restrictor may comprise a nozzle arrangement.

The nozzle arrangement may comprise a plurality of nozzles.

One or more nozzle may be disposed at a downstream location relative to the port. Where more than one nozzle is disposed at a downstream location relative to the port, the nozzles may be circumferentially spaced. For example, the nozzles may be arranged in an annular ring. Any number of nozzles may be provided. For example, the nozzle arrangement may comprise up to and including 40 nozzles.

One or more nozzle may be disposed at an upstream location relative to the port. Where more than one nozzle is disposed at an upstream location relative to the port, the nozzles may be circumferentially spaced. For example, the nozzles may be arranged in an annular ring. Any number of nozzles may be provided. For example, the nozzle arrangement may comprise up to and including 40 nozzles.

The nozzle or nozzles located at a downstream location relative to the port may be disposed in the opposite orientation to the nozzle or nozzles located at an upstream location relative to the port.

The nozzles may be disposed either side of the port.

The flow restrictor may be constructed from any suitable material. In particular embodiments, the flow control device may be constructed from a tungsten carbide material or the like.

The downhole tool may comprise a valve arrangement.

The valve arrangement may be configurable between an open configuration and a closed configuration.

The valve arrangement in the closed configuration may define a shut-in configuration of the downhole tool.

The valve arrangement may be configured to provide selective communication between an axial throughbore, such as the axial throughbore of the first sleeve device, the second sleeve device, the third sleeve device, the fourth sleeve device or the fifth sleeve device, and an annulus, such as the sleeve annulus of the first sleeve device, the second sleeve device, the third sleeve device, the fourth sleeve device or the fifth sleeve device.

The valve arrangement may be configured to provide selective communication between the port, such as the port of the first sleeve device, the second sleeve device, the third sleeve device, the fourth sleeve device or the fifth sleeve device, and the sleeve annulus.

The valve arrangement may be operatively associated with a port, such as the port of the first sleeve device, the second sleeve device, the third sleeve device, the fourth sleeve device or the fifth sleeve device. In some embodiments, the valve arrangement may be disposed around a port, such as the port of the first sleeve device, the second sleeve device, the third sleeve device, the fourth sleeve device or the fifth sleeve device. In some embodiments, the valve arrangement may be at least partially disposed in, or configured to engage with, a port, such as the port of the first sleeve device, the second sleeve device, the third sleeve device, the fourth sleeve device or the fifth sleeve device.

Beneficially, the provision of a downhole valve arrangement according to embodiments of the present invention may permit one or more sleeve to be isolated or moved to a shut-in configuration, while mitigating or eliminating the risk that a particular sleeve or sleeves associated with a lower pressure formation zone becoming plugged due to migration of particles from other, higher pressure, formation zones.

The valve arrangement may comprise a one-way valve arrangement. Beneficially, the provision of a one-way valve arrangement may prevent or mitigate flow back into the downhole tool.

The valve arrangement may be of any suitable form and construction.

The valve arrangement may comprise at least one closure member.

In particular embodiments, the valve arrangement may comprise a plurality of closure members.

The or each closure member may be configured to selectively close a single port. For example, a closure member may be associated with each port. Alternatively, the or each closure member may be configured to selectively close a plurality of ports. For example, a single closure member may be associated with a plurality of ports.

The valve arrangement may comprise a lateral fluid port. The closure member may be configured to close or shut the lateral fluid port of the valve arrangement. The closure member may alternatively or additionally be configured to close or shut the lateral fluid port of the downhole tool.

In some embodiments, the valve arrangement may be configured to move the closure member, or where there are a plurality of closure members at least one of the closure members, axially to move the valve arrangement between the open configuration and the closed configuration. The closure member may be configured to be axially moveable.

Alternatively or additionally, the valve arrangement may be configured to move the closure member, or where there are a plurality of closure members at least one of the closure members, radially to move the valve arrangement between the open configuration and the closed configuration.

The closure member may be of any suitable form and construction.

The closure member may comprise a piston or valve member.

The closure member may comprise a fluid actuated piston.

A first side of the closure member may communicate with fluid pressure downstream of the flow restrictor. A second side of the closure member may communicate with fluid pressure upstream of the flow restrictor. The closure member may be actuable by the pressure differential between fluid pressure downstream of the flow restrictor and fluid pressure upstream of the flow restrictor.

In particular embodiments, the closure member may be actuated by back pressure, such as back pressure in the annulus of the sleeve.

The closure member may comprise an annular piston.

In particular embodiments, the valve arrangement may comprise two or more closure members.

The closure members may be disposed on opposing sides of the lateral fluid port of the valve arrangement. A first of the closure members may be configured to engage a second of the closure members to close the valve arrangement. Alternatively, and in particular embodiments, the closure members may be configured to engage a flange. The flange may be disposed in the annulus. The flange may be integrally formed with the housing or may comprise or form part of a separate component.

The valve assembly may comprise a plurality of closure members disposed radially opposite to the lateral fluid ports of the downhole tool and which are radially moveable so as to define the open configuration which permits fluid passage through the lateral fluid ports and the closed or shut-in configuration which prevents fluid passage through the lateral fluid ports.

The closure member may comprise a body. The body may comprise a central body portion. The body may comprise a first end portion. The body may comprise a second end portion. At least one of the end portions may be hemi-cylindrical in shape.

The closure member may comprise one or more lug. The lug or lugs may extend axially from the end portion. A radially extending pin may be formed on the or each lug.

The pin may be adapted to slidingly engage a corresponding hole in the mounting bracket.

The valve arrangement may comprise a biasing member. The biasing member may be disposed around the pin and may be interposed between the closure member and the mounting bracket. The biasing member may comprise a spring. In particular embodiments, the spring may comprise a coil spring.

At least part of the valve assembly may be disposed in a recess in the mandrel.

At least part of the closure member may be formed from a hard material, such as tungsten carbide or other suitable material.

Alternatively, or additionally, the closure member may be configured to a deflection plate. The deflection plate may be formed of a hard material, such as tungsten carbide. The deflection plate may be secured to the central body portion. Any suitable means for securing the deflection plate to the central body portion may be used. In particular embodiments, the deflection plate may be secured to the closure member by one or more fastener, such as a bolt or screw. Alternatively, the deflection plate may be secured to the closure member by an adhesive or may be formed together with the closure member.

A radially inward surface of the closure member may be angled. Beneficially, the provision of an angled radially inward surface acts to deflect or direct fluid and mitigate erosional effects which may otherwise occur when the direction of flow is changed.

The mounting bracket may be of any suitable form. The mounting bracket may comprise a body portion. An end surface of the mounting bracket body portion may be formed or shaped for engagement with the hemi-cylindrical end of the closure member. The mounting bracket may comprise a lug for receiving a fastener to secure the mounting bracket to the mandrel.

The valve arrangement may be operable independently of a closure member of the sleeve. In some embodiments, the valve arrangement may comprise a secondary closure of the port of the sleeve.

The valve arrangement may comprise a fluid conduit or gallery.

The fluid conduit may provide fluid communication in the annulus when the valve arrangement is configured in the closed configuration.

The fluid conduit or gallery may be provided in the flange.

A plurality of fluid conduits or galleries may be provided.

At least one of the flow restrictor and the valve arrangement may form part of an insert assembly. The insert assembly may be configured for location in the annulus of a sleeve, such as the annulus of the first sleeve device, second sleeve device, third sleeve device, fourth sleeve device or fifth sleeve device.

The insert assembly may comprise a housing configured for location in the annulus of the sleeve.

The housing may comprise a unitary component. Alternatively, the housing may be modular. The housing may comprise a first housing portion. The first housing portion may comprise a downhole housing portion. The housing may comprise a second housing portion. The second housing portion may comprise an uphole housing portion.

The first housing portion and the second housing portion may be configured to be coupled together. The first housing portion, the second housing portion and the outer housing may together define a throughbore or secondary axial flow passage.

The first housing portion may be generally tubular in construction. The first housing portion may comprise one or more lateral ports. The lateral port of the first housing portion may be angled. For example, the lateral port of the first housing portion may be angled in a downhole direction so as to direct fluid flow in a downhole direction, this beneficially assisting in mitigating or eliminating erosion which may otherwise occur due to the change of direction of fluid exiting the lateral port.

The first housing portion may comprise a radially inwardly directed flange or lip. The flange or lip may be provided at a downhole end of the first housing portion. The flange or lip may space the first housing portion from the mandrel.

One or more axial port may be provided through the flange. The one or more axial port may provide access to a first, e.g. downhole, chamber of the valve arrangement.

The first housing portion may comprise a collar. The collar may be provided at the downhole end of the first housing portion. The collar may engage the outer housing.

One or more seal groove may be disposed in the collar. A seal element may be disposed in the or each groove. In use, the seal element or elements may provide a seal between the first housing portion and the outer housing.

One or more axial port may be provided in the collar. The or each axial port may be configured to receive a nozzle. The axial port may be circular.

A recess may be provided in an inner surface of the first housing portion. The recess may be provided at the uphole end of the first housing portion. The recess may provide a female end portion of the first housing portion for engaging the second housing portion.

The second housing portion may be generally tubular in construction. The second housing portion may comprise one or more lateral ports. The lateral port of the second housing portion may be angled. For example, the lateral port may be angled in an uphole direction so as to direct fluid flow in an uphole direction, this beneficially assisting in mitigating or eliminating erosion which may otherwise occur due to the change of direction of fluid exiting the lateral port.

The second housing portion may comprise a radially inwardly directed flange or lip. The flange or lip may be provided at an uphole end of the second housing portion. The flange or lip may space the second housing portion from the mandrel.

One or more axial port may be provided through the flange. The one or more axial port may provide access to an uphole chamber of the valve arrangement.

The second housing portion may comprise a collar. The collar may be provided at the uphole end of the second housing portion. The collar may engage the outer housing.

One or more seal groove may be disposed in the collar. A seal element may be disposed in the or each groove. In use, the seal elements may provide a seal between the second housing portion and the outer housing.

One or more axial port may be provided in the collar. The or each axial port may be configured to receive a nozzle. The axial port may be circular.

A radially extending boss may be provided on an outer surface of the second housing portion. The boss may provide a male end portion of the second housing portion for engaging the first housing portion.

The valve arrangement closure member or members may be disposed in the housing.

The housing may comprise an axial throughbore. The flow restrictor may be disposed in the axial throughbore. The flange may be disposed in the axial throughbore.

According to a second aspect of the present invention there is provided a flow control apparatus or arrangement according to the first aspect. The flow control apparatus or arrangement may be configured for coupling to a screen. The flow control apparatus or arrangement may be configured for coupling to a plurality of screens. The flow control apparatus may be disposed between adjacent screens.

According to a third aspect of the present invention there is provided a flow restrictor according to the first aspect.

According to a fourth aspect of the present invention there is provided a valve arrangement according to the first aspect.

According to a fifth aspect of the present invention there is provided a method. The method may comprise a method for controlling fluid flow into and/or from a formation. The method may comprise a method for treating a formation.

The method may comprise running a downhole tool into a wellbore. The method may comprise configuring a flow control apparatus or arrangement of the downhole tool to prevent passage of fluid through a screen of or operatively associated with the downhole tool. The method may comprise injecting a fluid into a formation zone. The method may comprise providing a return flow path for fluid. The method may comprise packing the annulus with a packing material.

According to a sixth aspect of the present invention there is provided a valve arrangement for a downhole tool, the valve arrangement comprising a closure member configured to move radially to move the valve arrangement between an open configuration and a closed configuration.

It should be understood that the features defined above in accordance with any aspect of the present invention or below in relation to any specific embodiment of the invention may be utilised, either alone or in combination, with any other defined feature, in any other aspect of the invention.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
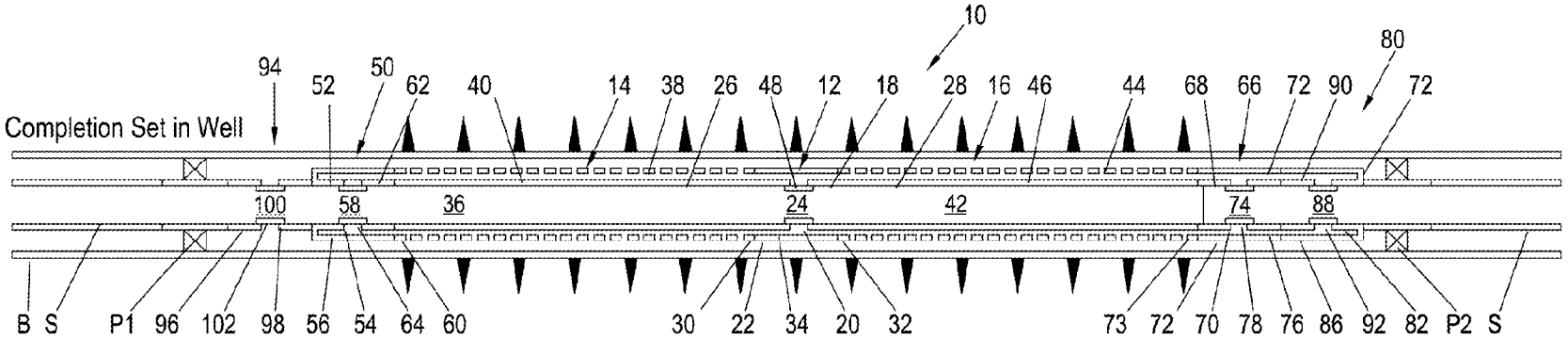
FIG. 1 is a diagrammatic view of a downhole tool according to an embodiment of the present invention, in a first configuration.

FIGS. 1 to 7 show diagrammatic views of a downhole tool 10 according to an embodiment of the present invention in different modes of operation. In use, the tool 10 is coupled to and forms part of a completion string S which is run into a borehole B. The string S is secured to the borehole B with the tool 10 adjacent a formation zone FZ and the formation zone FZ is isolated using packers P1, P2, the tool 10 operable to control fluid flow into or from the isolated formation zone FZ.

The tool 10 comprises a first sliding sleeve device 12 disposed between, and forming a coupling between, a first sand screen joint 14 and a second sand screen joint 16. The first sliding sleeve device 12 comprises a mandrel 18 having one or more lateral flow passage 20 and an outer housing 22

The inner mandrel 18 comprises a tubular member defining an axial throughbore 24 and is coupled at its uphole end (left end as shown in the Figures) to a base pipe 26 of the first sand screen joint 14 and at its downhole end (right end as shown in the Figures) to a base pipe 28 of the second sand screen joint 16.

The outer housing 22 is coupled at its uphole end to an end ring 30 of the first sand screen joint 14 and at its downhole end to an end ring 32 of the second sand screen joint 16. As can be seen from FIG. 1, an annulus 34 is defined between the mandrel 18 and the outer housing 22.

The base pipe 26 of the first sand screen joint 14 comprises a tubular member which defines an axial throughbore 36. While the base pipe of a conventional sand screen joint is perforated to permit the passage of fluid into or from the completion string, the base pipe 26 of the first sand screen joint 14 comprises a solid tubular, that is there are no perforations permitting the lateral passage of fluid. One or more filter media layer 38 is disposed around the base pipe 26 and the base pipe 26 and the filter media layer or layers 38 are positioned so as to define an annulus 40 therebetween.

The base pipe 28 of the second sand screen joint 16 comprises a tubular member which defines an axial throughbore 42. The base pipe 28 of the second sand screen joint 16 also comprises a solid tubular and one or more filter media layer 44 is disposed around the base pipe 28. The base pipe 28 and the filter media layer or layers 44 are positioned so as to define an annulus 46 therebetween.

As shown in FIG. 1, the device 12 and the screen joints 14, 16 are coupled together so that the axial throughbores 24, 36, and 42 are substantially contiguous. Similarly, the annuli 34, 40 and 46 of the first sliding sleeve device 12 and the screen joints are also substantially contiguous with each other and define an axial flow passage separate from the axial throughbores 24, 36, 42.

A sleeve 48 is slidably disposed within the mandrel 18 and, in use, the sleeve 48 is used to open and close the lateral flow passage or passages 20 to selectively permit access between the axial flow passage and the axial throughbore 24.

A second sliding sleeve device 50 is disposed at an uphole end of the first sand screen joint 14 and in the illustrated embodiment the second sliding sleeve device 50 comprises a high volume injection sleeve. The second sliding sleeve device 50 comprises a mandrel 52 having one or more lateral flow passage 54 and an outer housing 56. The mandrel 52 comprises a tubular member defining an axial throughbore 58 and is coupled at its downhole end (right end as shown in the Figures) to the uphole end of the base pipe 26 of the first sand screen joint 16. The outer housing 56 is coupled at its downhole end to an upper end ring 60 (see FIGS. 8 to 10) of the first sand screen joint 14. As can be seen from the Figures, an annulus 62 is defined between the mandrel 52 and the outer housing 56. The second sliding sleeve device 50 and the screen joint 14 are coupled together so that the axial throughbores 58 and 36 are substantially contiguous.

Similarly, the annuli 40, 62 are also substantially contiguous with each other and also form the axial flow passage separate from the axial throughbores 24, 36, 42. A sleeve 64 is slidably disposed within the mandrel 52 and, in use, the sleeve 64 is used to open and close the lateral flow passage or passages 54 to selectively permit access between the axial flow passage and the axial throughbore of the tool 10.

A third sliding sleeve device 66 is disposed at a downhole end of the second sand screen joint 16 and in the illustrated embodiment the third sliding sleeve device 66 also comprises a high volume injection sleeve. The third sliding sleeve device 66 comprises a mandrel 68 having one or more lateral flow passage 70 and an outer housing 72. The mandrel 68 comprises a tubular member defining an axial throughbore 74 and is coupled at its uphole end (left end as shown in the Figures) to the downhole end of the base pipe 28 of the second sand screen joint 18. The outer housing 72 is coupled at its uphole end to the lower end ring 73 of the second sand screen joint 16. As can be seen from the Figures, an annulus 76 is defined between the mandrel 68 and the outer housing 72. The third sliding sleeve device 66 and the screen joint 16 are coupled together so that the axial throughbores 36, 74 are substantially contiguous. Similarly, the annuli 46, 76 are also substantially contiguous with each other and also form the axial flow passage separate from the axial throughbores of the tool 10. A sleeve 78 is slidably disposed within the mandrel 68 and, in use, the sleeve 78 is used to open and close the lateral flow passage or passages 70 to selectively permit access between the axial flow passage and the axial throughbore of the tool 10.

A fourth sliding sleeve device 80 is disposed at a downhole end of the third sliding sleeve device 66. The fourth sliding sleeve device 80 comprises a mandrel 82 having one or more lateral flow passage 84 and an outer housing 86. The mandrel 82 comprises a tubular member defining an axial throughbore 88 and is coupled at its uphole end (left end as shown in the Figures) to the downhole end of the mandrel 68 of the third sliding sleeve device 66. The outer housing 86 is coupled at its uphole end to the outer housing 72 of the third sliding sleeve device 66. As can be seen from the Figures, an annulus 90 is defined between the mandrel 82 and the outer housing 86. The fourth sliding sleeve device 80 and the third sliding sleeve device 66 are coupled together so that their axial throughbores are substantially contiguous. Similarly, their annuli are also substantially contiguous with each other and also form the axial flow passage separate from the axial throughbores of the tool 10. A sleeve 92 is slidably disposed within the mandrel 82 and, in use, the sleeve 92 is used to open and close the lateral flow passage or passages 84 to selectively permit access between the axial flow passage and the axial throughbore of the tool 10.

A fifth sliding sleeve device—which will be referred hereinbelow as fracture sleeve 94—is disposed at an uphole end of the second sliding sleeve 50. The fracture sleeve 94 comprises a mandrel 96 having one or more lateral flow passage 98. The mandrel 96 comprises a tubular member defining an axial throughbore 100 and is coupled at its downhole end (right end as shown in the Figures) to the uphole end of the mandrel 52 of the second sliding sleeve device 50. As can be seen from the Figures, the fracture sleeve 94 and the second sliding sleeve device 50 are coupled together so that their axial throughbores are substantially contiguous. A sleeve 102 is slidably disposed within the mandrel 96 and, in use, the sleeve 102 is used to open and close the lateral flow passage or passages 98.

As described above, the formation zone to be operated upon is first isolated using packers and in the illustrated embodiment two packers P1, P2 are disposed on the string S: a first uphole packer P1 and a second downhole packer P2. In the illustrated embodiment, the packers P1 and P2 comprise CZI Zonal Isolation Packers from Petrowell Limited, although other packers may be used where appropriate.

Exemplary operation of the downhole tool 10 will now be described further with reference to FIGS. 1 to 7.

Referring first to FIG. 1, the completion string S has been run into the borehole B so that the tool 10 is disposed adjacent a formation zone FZ and the packers P1, P2 have been set against the borehole wall to isolate the formation zone FZ. In this configuration, all of the sliding sleeve devices are configured in their respective run-in configurations with the sleeves preventing passage of fluid between the isolated formation zone FZ and the axial throughbore of the tool 10 via the sleeves. While fluid from the formation zone FZ may pass through the filter media layer or layers of the sand screen joints into the separate axial flow passage defined by the annuli, since the base pipes of the first and second sand screen joints are non-perforated fluid may not pass directly into the axial throughbore with the sleeves closed.

Figure 2:
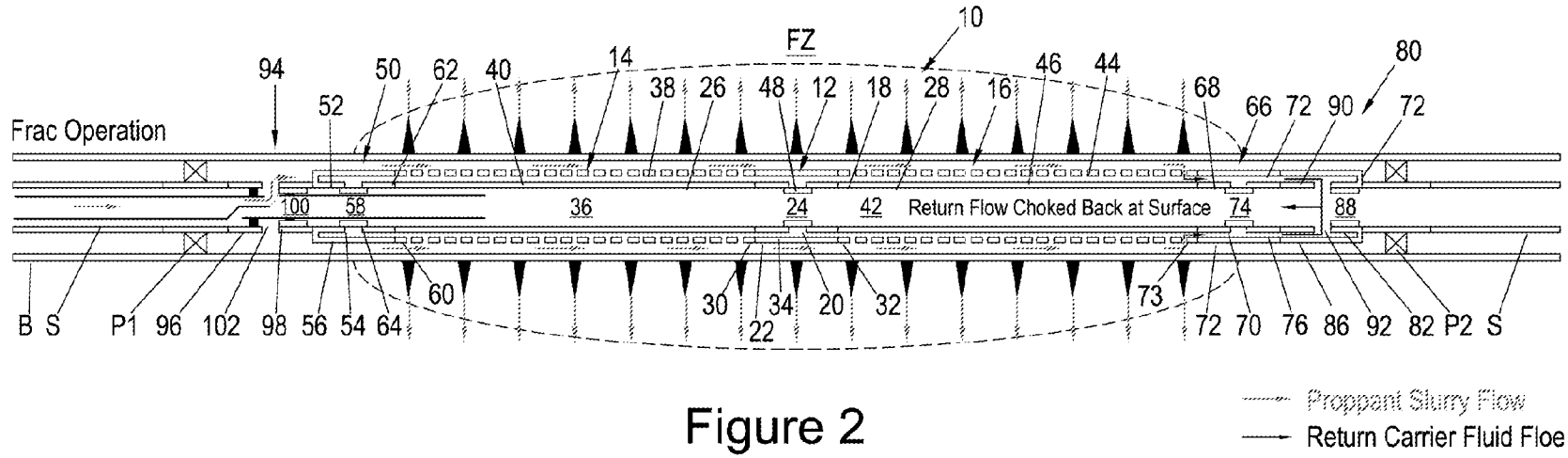
FIG. 2 is a diagrammatic view of the downhole tool of FIG. 1, shown in a second configuration.

Referring now to FIG. 2, there is shown a diagrammatic view of the tool 10 in a second configuration, the tool 10 in the second configuration permitting the controlled injection of fluid into the formation zone in order to perform a fracturing operation. As shown in FIG. 2, a fracturing tool (shown diagrammatically at 108) is run into the borehole through the axial throughbore of the completion string S and disposed within the tool 10. As shown in FIG. 2, the fracturing tool 108 defines a first fluid conduit 110 and a second fluid conduit 112 which is separate from the first conduit 110.

In the configuration shown in FIG. 2, the fracture sleeve and the return sleeve are configured in their open configuration while sleeves 12, 50, 66 remain closed.

In use, the fracturing tool 108 is disposed within the tool 10 so that fracturing fluid—which includes a proppant and a carrier—may be directed through the first fluid conduit of the fracturing tool 108 and through the lateral passage of the fracture sleeve into the annulus between the tool 10 and the borehole and onwards into the formation zone FZ. Seals 114,116 are provided on the fracturing tool to prevent leakage of the fracturing fluid between the fracturing tool 108 and the tool 10. It will be recognised that a portion of the fracturing fluid will enter the formation zone FZ and a portion of the fracturing fluid will travel along the separate flow passage defined by the annuli and re-enter the tool 10 through the open return sleeve and return to surface via the second conduit of the fracturing tool 108. The return flow may be choked from surface in order to assist the operator is controlling the circulation of the fracturing fluid as required.

Beneficially, embodiments of the invention permit a fracturing operation such as described above to be carried out while preventing fluid ingress into the tool 10 through the sand screen joints.

Figure 3:
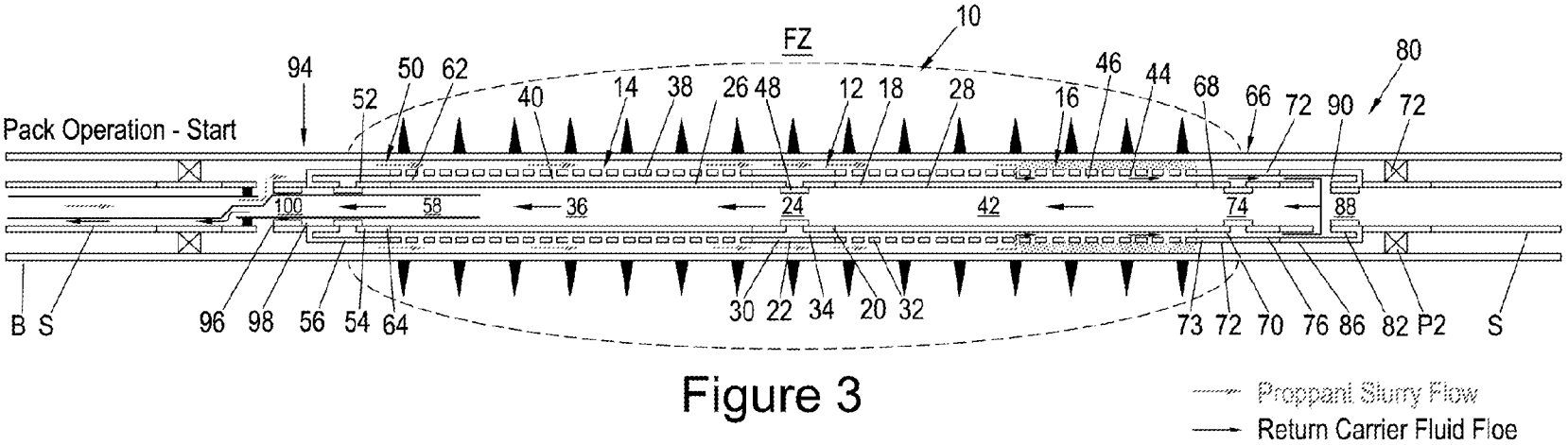
FIG. 3 is a diagrammatic view of the downhole tool of FIGS. 1 and 2, shown in a third configuration.
Figure 4:
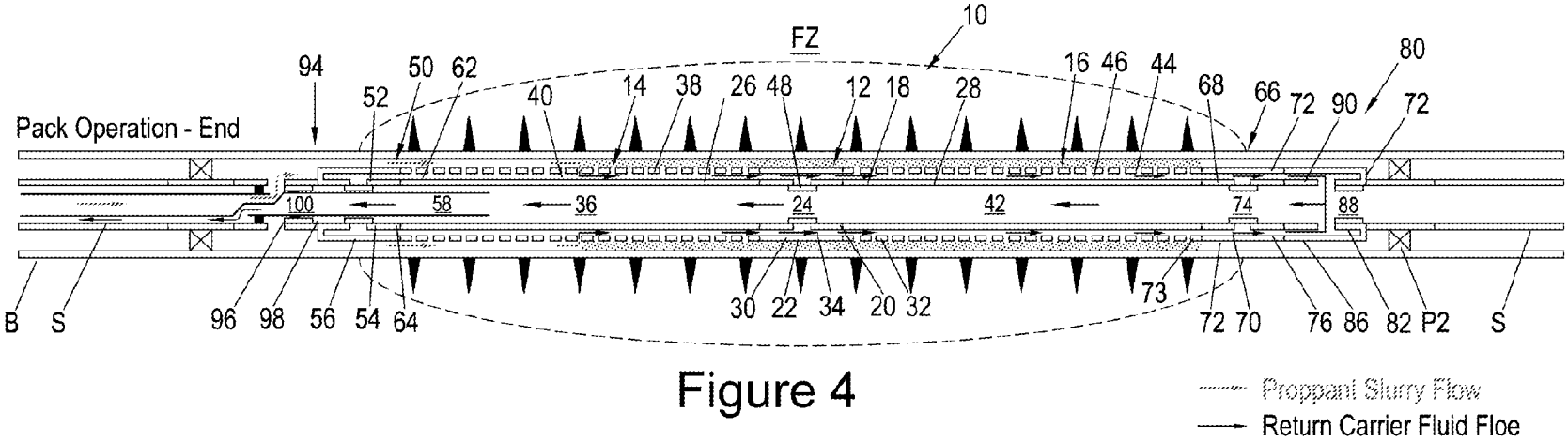
FIG. 4 is a diagrammatic view of the downhole tool of FIGS. 1 to 3, shown in a fourth configuration.

Referring now to FIGS. 3 and 4, there are shown diagrammatic views of the tool 10, the tool 10 performing a packing operation of the formation zone FZ. As can be seen from FIGS. 3 and 4, the tool 10 is configured in the same configuration as used to perform the packing operation. During the packing stage, the proppant from the fracturing fluid will begin to dehydrate against the sand screen joints and so pack the outer annulus A between the tool 10 and the borehole wall while the residual carrier fluid is able to flow back into the completion string S and back to surface. Since the tool ensures that fluid is circulated the full length of the formation zone FZ and re-enters the tool 10 via the return sleeve, dehydration of the proppant will begin at the downhole end of the formation zone FZ (as shown in FIG. 3) and progress uphole until the full length of both sand screen joints 16,18 (as shown in FIG. 4). In this way, the full length of the sand screen joints 16, 18 may be packed to prevent undesirable ingress of entrained material restricting production.

Figure 5:
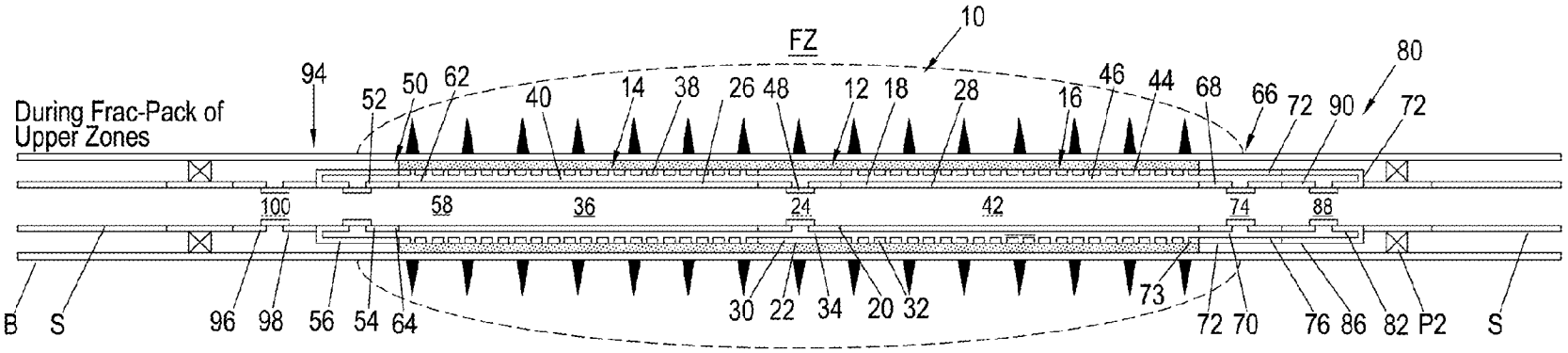
FIG. 5 is a diagrammatic view of the downhole tool of FIGS. 1 to 4, shown in a fifth configuration.

Once the frac-pack operation described above has been completed, and referring now to FIG. 5, the fracturing tool 108 may be removed and the shifting tool operated to close the return sleeve and the fracture sleeve. Thus, in the configuration shown in FIG. 5 the formation zone FZ is isolated, this facilitating for example another formation zone to be operated upon.

Figure 6:
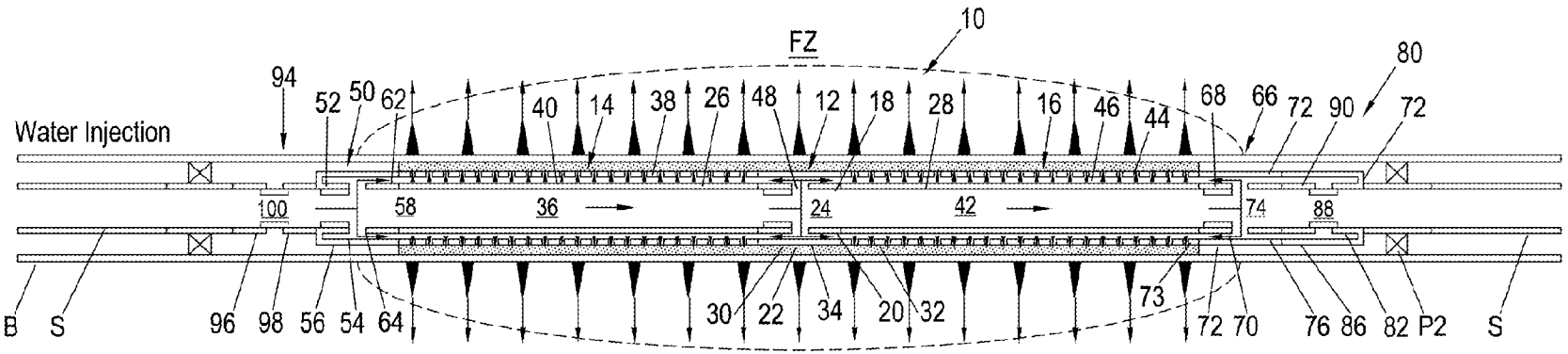
FIG. 6 is a diagrammatic view of the downhole tool of FIGS. 1 to 5, shown in a sixth configuration.
Figure 7:
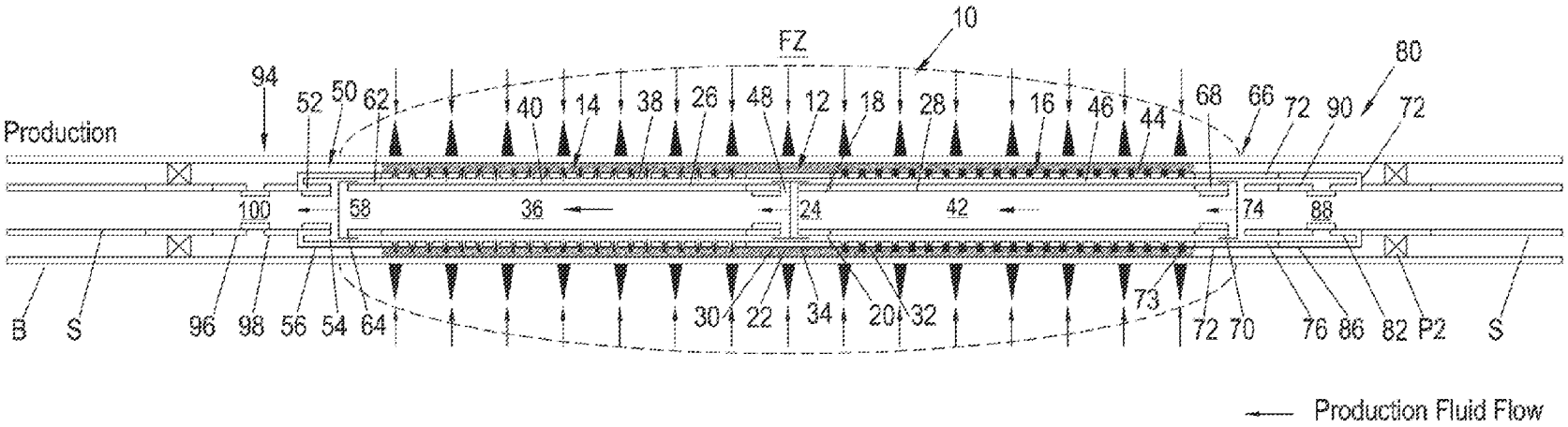
FIG. 7 is a diagrammatic view of the downhole tool of FIGS. 1 to 6, shown in a sixth configuration.

When it is desired to begin production of hydrocarbons from the formation zone or perform another operation in the formation zone, such as water injection, a shifting tool may be run into the tool 10 and operated to open the sleeves 12, 50, 66 to permit fluid ingress into (in the case of production for example) or fluid egress out of (in the case of water injection for example) the tool 10. By way of example, FIG. 6 shows a diagrammatic view of the downhole tool 10 with sleeves 12, 50, 66 open to permit the injection of fluid, such as water, into the formation zone FZ and FIG. 7 shows a diagrammatic view of the downhole tool 10 with sleeves 12, 50, 66 open to receive production fluid from the formation zone FZ.

Figure 8:
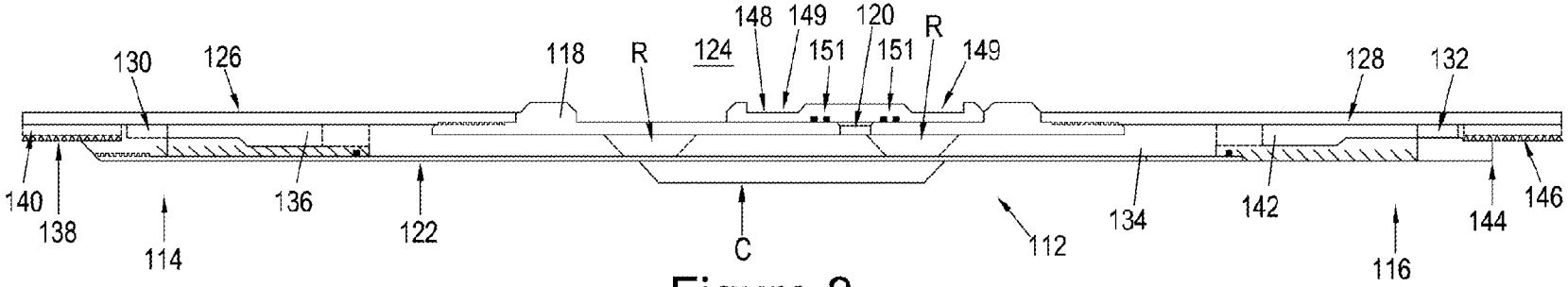
FIG. 8 is a longitudinal half section view of a downhole tool according to an embodiment of the present invention.
Figure 9:
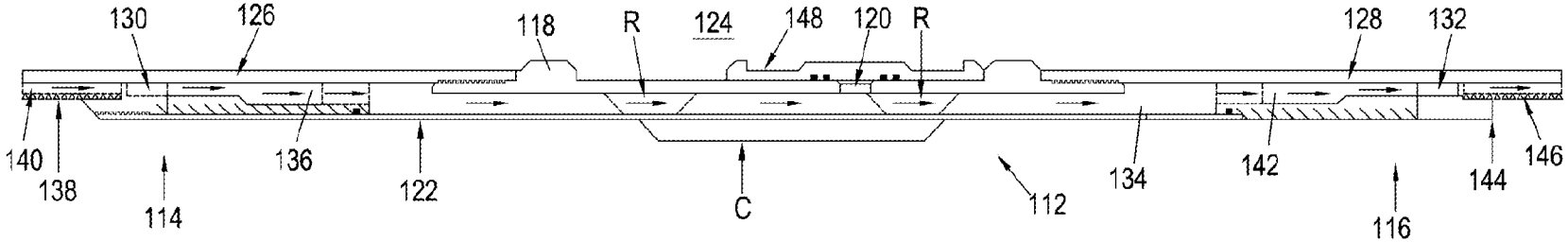
FIG. 9 is a longitudinal diagrammatic view of the downhole tool shown in FIG. 8.
Figure 10:
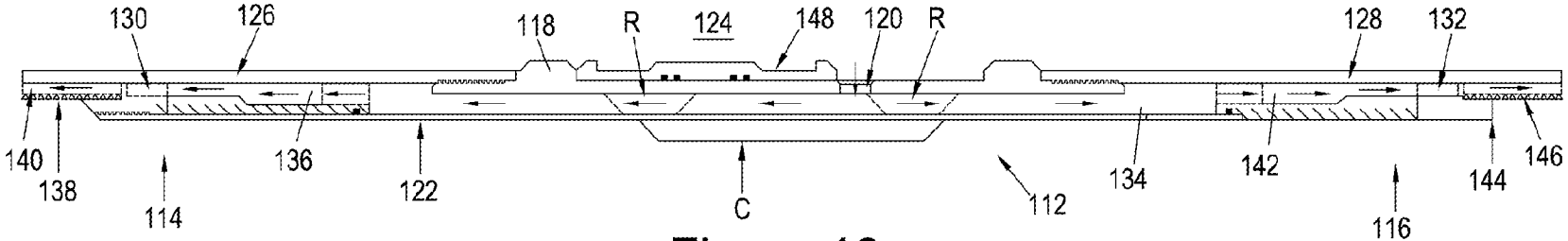
FIG. 10 is a longitudinal diagrammatic view of a downhole tool according to the present invention.

Referring now to FIGS. 8 to 10, there are shown longitudinal half sectional views of a sliding sleeve device 112 suitable for use in embodiments of the present invention. The sliding sleeve device 112 may be used as the sliding sleeve device 12 described above and, where applicable, like reference numerals incremented by 100 have been used to designate like components.

As shown in the figures, sliding sleeve device 112 is disposed between, and forms a coupling between, a first sand screen joint 114 and a second sand screen joint 116. The sliding sleeve device 112 comprises a mandrel 118 having one or more lateral flow passage 120 and an outer housing 122.

The mandrel 118 comprises a tubular member defining an axial throughbore 124 and is coupled at its uphole end (left end as shown in the Figures) to a base pipe 126 of the first sand screen joint 114 via a threaded connection, in particular a premium thread connection, and at its downhole end (right end as shown in the Figures) to a base pipe 128 of the second sand screen joint 116 via a threaded connection, in particular a premium thread connection.

The outer housing 122 is a tubular member and is coupled at its uphole end to an end ring 130 of the first sand screen joint 114 by a threaded connection and at its downhole end to an end ring 132 of the second sand screen joint 116 by a threaded connection. An uphole region of the outer surface (shown in hatching) of the housing 122 is configured to receive tongs for making up the tool 112 on surface.

An annulus 134 is defined between the mandrel 118 and the outer housing 122 and ribs R are provided on either or both of the mandrel and outer housing to provide the annulus 134.

The base pipe 126 of the first sand screen joint 114 comprises a tubular member which defines an axial throughbore 136. As described above, while the base pipe of a conventional sand screen joint is perforated to permit the passage of fluid into or from the completion string, the base pipe 126 of the first sand screen joint 114 comprises a solid tubular, that is there are no perforations permitting the lateral passage of fluid. One or more filter media layer 138 is disposed around the base pipe 126 and the base pipe 126 and the filter media layer or layers 138 are positioned so as to define an annulus 140 therebetween. The base pipe 128 of the second sand screen joint 116 comprises a tubular member which defines an axial throughbore 142. The base pipe 128 of the second sand screen joint 116 also comprises a solid tubular and one or more filter media layer 144 is disposed around the base pipe 128. The base pipe 128 and the filter media layer or layers 144 are positioned so as to define an annulus 146 therebetween. As shown in the Figures, the device 112 and the screen joints 114, 116 are coupled together so that the axial throughbores 124, 136, and 142 are substantially contiguous. Similarly, the annuli 134, 140 and 146 of the first sliding sleeve device 112 and the screen joints are also substantially contiguous with each other and define an axial flow passage separate from the axial throughbores 124, 136, 142.

A sleeve 148 is slidably disposed within the mandrel 118 and seal rings 151 are provided in the sleeve 148 on either side of the lateral flow passage 120 to prevent leakage between the sleeve 148 and the mandrel 118. In use, the sleeve 148 is used to open and close the lateral flow passage or passages 120 to selectively permit access between the axial flow passage and the axial throughbore 124. Shoulders are provided on the inner surface of the mandrel 148 which provide end stops for travel of the sleeve 148. Recesses 149 are provided in the inner surface of the sleeve 148 which permit manipulation of the sleeve 148 by a shifting tool (not shown).

In this embodiment, a centraliser C is disposed around the tool device 112 to assist in positioning the device 112 in the borehole.

FIGS. 8 and 9 shows the device 112 configured so the lateral port is covered by the sleeve 148, the arrows in FIG. 9 showing the direction of passage of fluid during a packing operation.

FIG. 10 shows the device 112 configured so the lateral port is open, the arrows showing the direction of passage of fluid during an injection operation.

As described above, embodiments of the present invention provide a number of benefits.

During frac-pack operations, the return flow of residual carrier fluid is restricted to a single return point in the completion and service tools at the base of each zone.

By opening only the sliding sleeve of the lowest of these units in a zone when conducting the pack portion of the frac-pack operation will allow residual carrier fluid from the reservoir/well bore section to be able to enter the annulus between the filter media and the base pipe of any of the sand screen joints across the zone and then travel down to enter the completion and service tools through the ports in the open device. This fluid path will cause the proppant to dehydrate against the screens at the lowest point in the zone and then steadily pack back from that point until it covers all of the screens across that zone.

Figure 11:
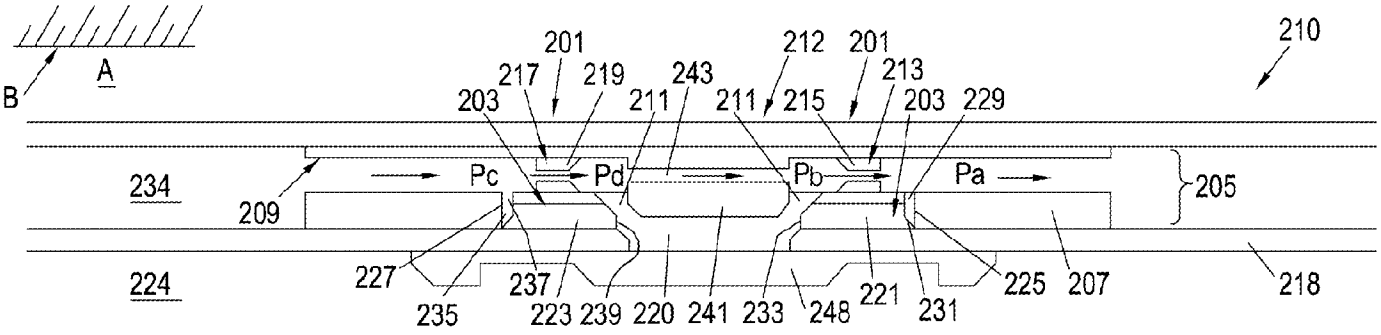
FIG. 11 is a diagrammatic view of a downhole tool portion of a downhole tool according to an embodiment of the present invention, in a first configuration.
Figure 12:
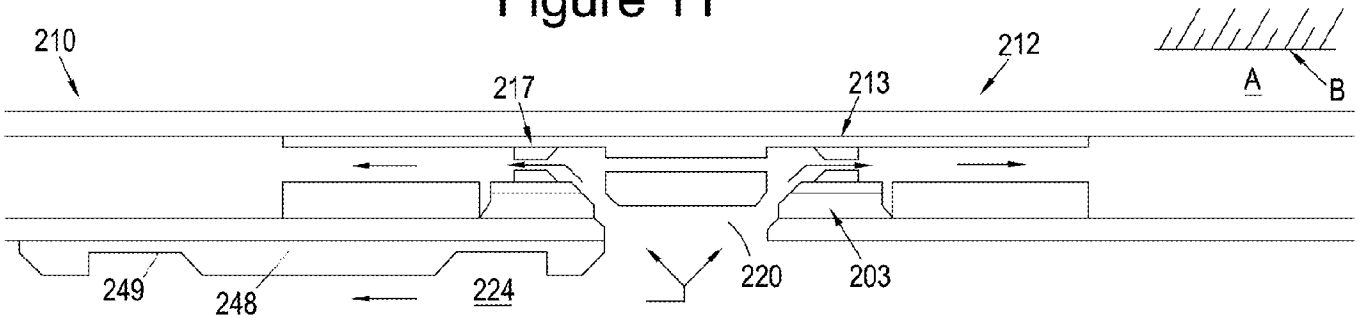
FIG. 12 is a diagrammatic view of the downhole tool portion shown in FIG. 11, in a second configuration.
Figure 13:
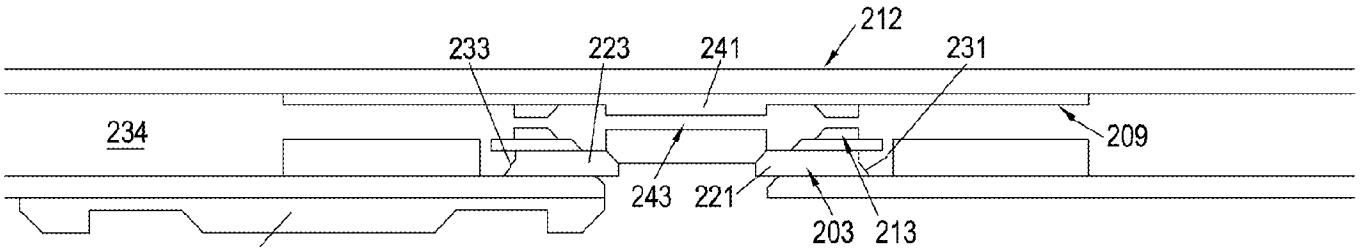
FIG. 13 is a diagrammatic view of the downhole tool shown in FIGS. 11 and 12, in a third configuration.

Referring now to FIGS. 11 to 13, there is shown longitudinal half-sectional views of a sliding sleeve device 212 of a downhole tool 210 according to an another embodiment of the present invention. The sliding sleeve device 212 may be used as the sliding sleeve device 12 described above and, where applicable, like reference numerals incremented by 200 have been used to designate like components. However, it will be recognised that the features of the sliding sleeve device 212 may be used in any other sleeve device, such as the second sliding sleeve device 50, third sliding sleeve device 66, fourth sliding sleeve device 80 or fifth sliding sleeve device 94 described above or other flow control apparatus.

As with the sliding sleeve device 12, the sliding sleeve device 212 comprises a mandrel 218 having one or more lateral flow passage 220 and an outer housing 222. The mandrel 218 comprises a tubular member defining an axial throughbore 224. An annulus 234 is defined between the mandrel 218 and the outer housing 222. A sleeve 248 is slidably disposed within the mandrel 218 and, in use, the sleeve 248 is used to open and close the lateral flow passage or passages 220 to selectively permit access between the axial flow passage/annulus 234 and the axial throughbore 224.

In this embodiment, the sliding sleeve device 212 is provided with a flow restrictor 201 and a valve assembly 203, which in the illustrated embodiment form part of an insert assembly 205 configured for location in the annulus 234.

The insert assembly 205 comprises a tubular housing 207 having an axial throughbore 209 and a lateral fluid port 211 which is disposed adjacent to and communicates with the lateral flow passage 220.

A first nozzle assembly 213 is disposed in the axial throughbore 209 at a downstream or downhole location relative to the lateral fluid port 211 (to the right as shown in the figures). In the illustrated embodiment, the first nozzle assembly 213 comprises an annular ring of nozzles 215 (one nozzle 215 is shown in section).

A second nozzle assembly 217 is disposed in the axial throughbore 209 at an upstream or uphole location relative to the lateral fluid port 211 (to the left as shown in the figures). In the illustrated embodiment, the second nozzle assembly 217 comprises an annular ring of nozzles 219 (one nozzle 219 is shown in section).

The valve arrangement 203 comprises a first annular piston 221 disposed at a downstream or downhole location relative to the lateral fluid port 211 and a second annular piston 223 disposed at an upstream or uphole location relative to the lateral fluid port 211. As shown in the figures, the first piston 221 is disposed in a first recess 225 formed in the housing 207 and the second piston 223 is disposed in a second recess 227 formed in the housing 207. A first chamber 229 is interposed between a lower end face 231 of the first piston 221 and the housing 207 and communicates with fluid pressure Pa downstream of the first nozzle assembly 213. An upper end face 233 of the first piston 221 communicates with fluid pressure Pb upstream of the first nozzle assembly 213. A second chamber 235 is interposed between an upper end face 237 of the second piston 223 and the housing 207 and communicates with fluid pressure Pc uphole of the second nozzle assembly 217. A lower end face 239 of the second piston 223 communicates with fluid pressure Pd downhole of the second nozzle assembly 217.

A flange 241 is formed in the throughbore 209, the flange 241 extending radially inwards from the housing 207 at a position opposite the lateral fluid port 211. The flange 241 forms an abutment for the pistons 221, 223.

In use, the pistons 221, 223 are actuable to move the valve arrangement 203 from an open configuration (as shown in FIGS. 11 and 12) to a closed configuration (as shown in FIG. 13) by back pressure which may be controlled by manipulating the fluid flow in the annulus 234 and throughbore 209 using pumps at surface (not shown).

An axial cross-communication port or gallery 243 is provided through the flange 241, such that fluid communication through the throughbore 209 is maintained when the valve arrangement 203 is closed.

Exemplary operation of the sliding sleeve device 212 will now be described with reference to FIGS. 11 to 13.

FIG. 11 shows the sliding sleeve device 212 during a packing operation, such as the packing operation described above with reference to FIGS. 3 and 4 and like numerals are used to describe like features and components. In the configuration shown in FIG. 11, the sleeve 248 is closed and the valve arrangement 203 is in the open configuration.

During the packing operation, proppant from fracturing fluid used to fracture the formation zone FZ will begin to dehydrate and so pack the outer annulus A between the tool 210 and the borehole B while the residual carrier fluid is able to flow back into the completion string S (shown in FIGS. 3 and 4), travel in a downstream direction along the annulus 234 and back to surface via the throughbore 224.

As shown by the arrows in FIG. 11, the proppant flows along annulus 234, into axial throughbore 209 of housing 207, through second nozzle assembly 217, around and through (via the cross communication gallery 243) the flange 241, and through first nozzle assembly 213.

FIG. 12 shows the sliding sleeve device 212 during a fluid injection operation, such as the water injection operation described above with reference to FIG. 6 and like numerals are used to describe like features and components. A shifting tool (not shown) may be run into the tool 210 and engaged with a recess 249 or shifting profile and operated to open the sleeve 248 to facilitate fluid egress out of the tool 210 and into the formation zone FZ (shown in FIGS. 3 and 4). In the configuration shown in FIG. 12, the sleeve 248 is therefore shown in the open position while the valve arrangement 203 is still in the open configuration.

During the injection operation, fluid (such as water) is directed through the throughbore 224 and radially outwards through the open port 220. As can be seen from FIG. 12, a portion of the fluid is diverted in a downhole direction (to the right as shown in the figures) through the first nozzle assembly 213 while another portion of the fluid is diverted in an uphole direction (to the left as shown in the figures) through the second nozzle assembly 217. The nozzle assemblies 213, 217 are configured to alter the fluid dynamics of the fluid flow, such that erosion which may otherwise occur (in particular as a result of the diversion of the fluid flow by substantially 90 degrees) is mitigated, or eliminated. For example, the flow dynamics may be altered such that the location at which erosion may occur is preferentially located downstream of the port.

FIG. 13 shows the sliding sleeve device 212 in a shut-in configuration. In the configuration shown in FIG. 13, the sleeve 248 is closed and the valve arrangement 203 is in the closed configuration. When it is desired to shut-in the device 212, the flow of fluid in the annulus 234 is manipulated from surface or by other means, such that a back pressure acts on the lower end face 231 of the first piston 221 and the upper end face 233 of the second piston 223, urging the pistons 221, 223 into engagement with the flange 241 and isolating the throughbore 224 from the housing throughbore 209. Fluid communication through the throughbore 209 is maintained via the cross communication gallery 243.

Figure 14:
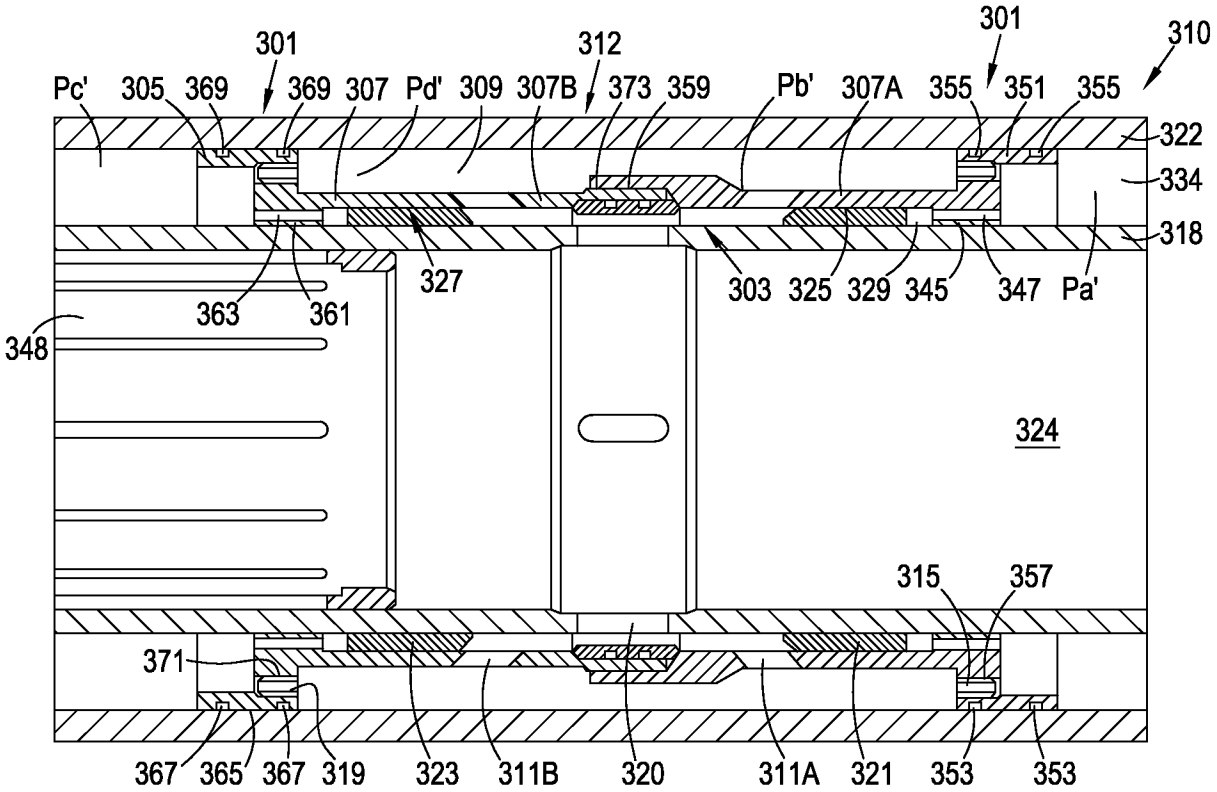
FIG. 14 is a longitudinal section view of a downhole tool portion of a downhole tool according to another embodiment of the present invention, in a first configuration.
Figure 15:
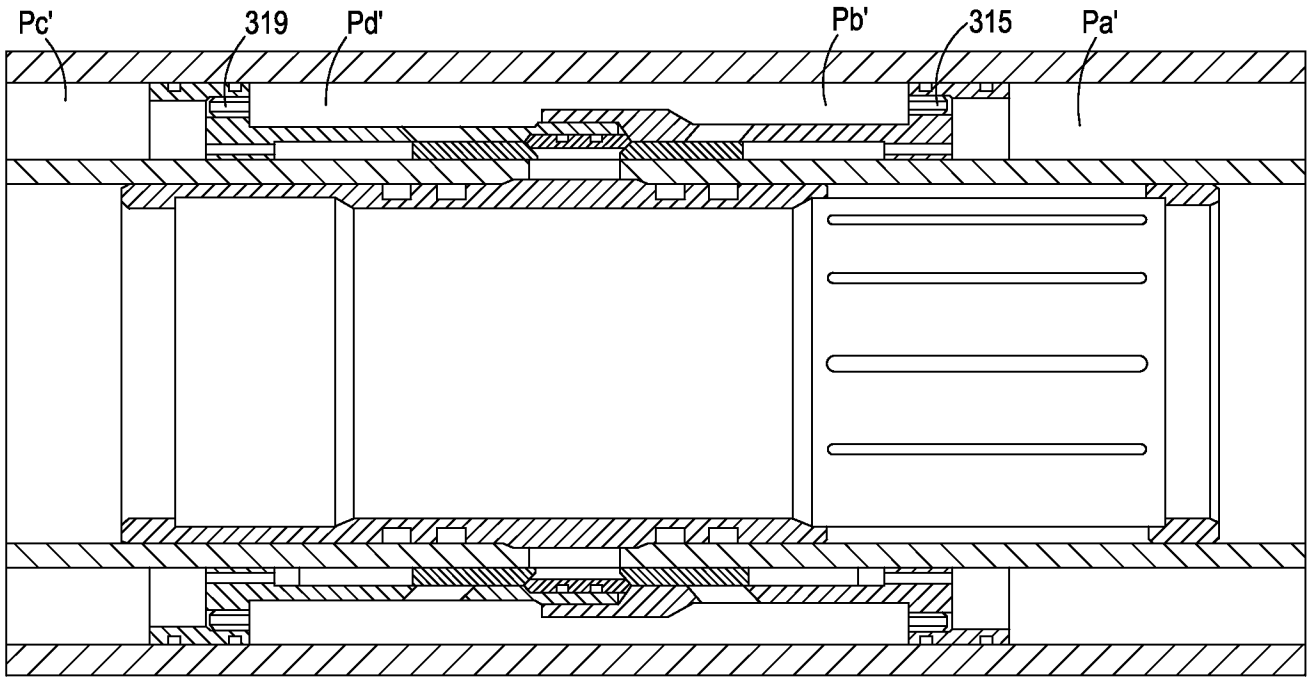
FIG. 15 is a longitudinal section view of the downhole tool portion shown in FIG. 14, in a second configuration.
Figure 16:
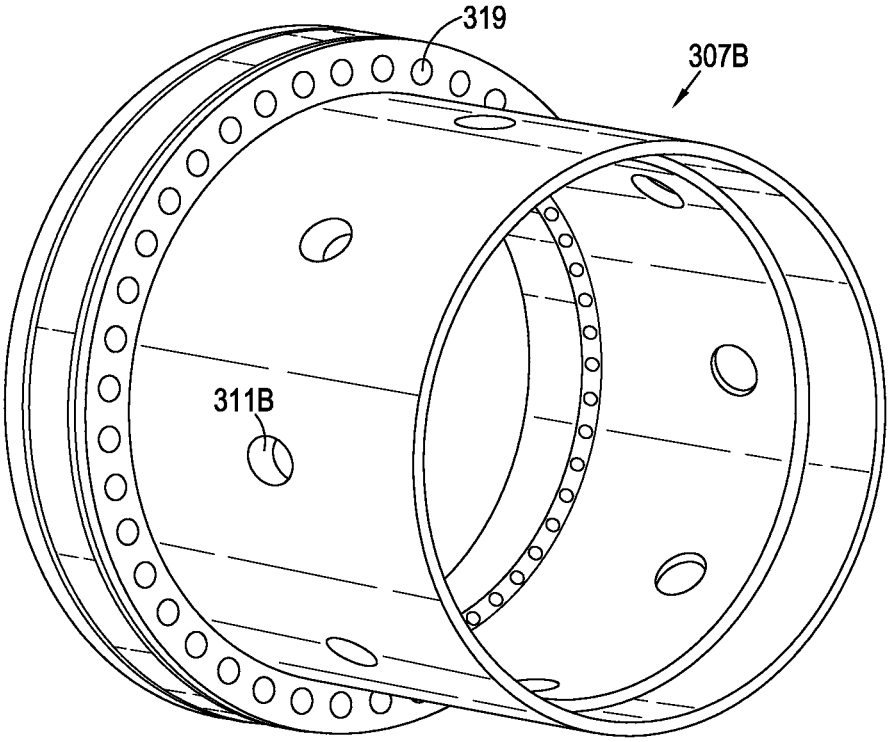
FIG. 16 is a perspective view of a housing portion of the downhole tool portion shown in FIGS. 14 and 15.

Referring now to FIGS. 14 to 16, there is shown a sliding sleeve device 312 of a downhole tool 310 according to another embodiment of the present invention. The sliding sleeve device 312 may be used as the sliding sleeve device 12 described above and, where applicable, like reference numerals incremented by 300 have been used to designate like components. However, it will be recognised that some or all of the features of the sliding sleeve device 312 may be used in any other sleeve device, such as the second sliding sleeve device 50, third sliding sleeve device 66, fourth sliding sleeve device 80 or fifth sliding sleeve device 94 described above or other flow control apparatus.

As with the sliding sleeve device 212, the sliding sleeve device 312 comprises a mandrel 318 having one or more lateral flow passage 320 (two lateral flow passages 320 are shown in section in FIGS. 14 and 15) and an outer housing 322. The mandrel 318 comprises a tubular member defining an axial throughbore 324. An annulus 334 is defined between the mandrel 318 and the outer housing 322. A sleeve 348 is slidably disposed within the mandrel 318 and, in use, the sleeve 348 is used to open and close the lateral flow passage or passages 320 to selectively permit access between the axial flow passage/annulus 334 and the axial throughbore 324.

In the embodiment shown in FIGS. 14 to 16, the sliding sleeve device 312 is provided with a flow restrictor 301 and a valve assembly 303, which in the illustrated embodiment form part of an insert assembly 305 configured for location in the annulus 334.

The insert assembly 305 comprises a tubular housing 307. In this embodiment, the tubular housing 307 is modular, having a first, downhole, housing portion 307A and a second, uphole, housing portion 307A configured to be coupled together. The first housing portion 307A, the second housing portion 307B and the outer housing 322 together define a throughbore 309 or secondary axial flow passage.

The first housing portion 307A is generally tubular in construction and is provided with one or more lateral ports 311A. In the illustrated embodiment, eight circumferentially spaced lateral ports 311A are provided in the first housing portion 307A, two of which are shown in section in FIG. 14. The lateral ports 311A are angled in a downhole direction so as to direct fluid flow in a downhole direction, this beneficially assisting in mitigating or eliminating erosion which may otherwise occur due to the change of direction of fluid exiting the lateral ports 311A. A radially inwardly directed flange or lip 345 is provided at a downhole end of the first housing portion 307A. The flange 345 spaces the first housing portion 307A from the mandrel 318. One or more axial port 347 is provided through the flange 345 and provides access to a downhole chamber 329 of valve assembly 303.

A collar 351 is provided at the downhole end of the first housing portion 307A and engages the outer housing 322. One or more seal groove 353 is disposed in the outer surface of the collar 351 (two seal grooves 353 are shown) and a seal element 355 is disposed in each groove 353. In use, the seal elements 355 provide a seal between the first housing portion 307A and the outer housing 322.

One or more axial port 357 (two ports 357 are shown in section in FIG. 14) is provided in the collar 351, each port 357 receiving a nozzle 315. In the illustrated embodiment, the axial port 357 is circular.

A recess 359 is provided in an inner surface of the first housing portion 307A at its uphole end, the recess 359 providing a female end portion of the first housing portion 307A for engaging the second housing portion 307B.

The second housing portion 307B is generally tubular in construction and is provided with one or more lateral ports 311B. In the illustrated embodiment, eight circumferentially spaced lateral ports 311B are provided in the first housing portion 307B, two of which are shown in section in FIG. 14. The lateral ports 311B are angled in an uphole direction so as to direct fluid flow in an uphole direction, this beneficially assisting in mitigating or eliminating erosion which may otherwise occur due to the change of direction of fluid exiting the lateral ports 311B. A radially inwardly directed flange or lip 361 is provided at an uphole end of the second housing portion 307B. The flange 361 spaces the second housing portion 307B from the mandrel 318. One or more axial port 363 is provided through the flange 361 and provides access to an uphole chamber 335 of valve assembly 303.

A collar 365 is provided at the uphole end of the second housing portion 307B and engages the outer housing 322. One or more seal groove 367 is disposed in the outer surface of the collar 365 (two seal grooves 367 are shown) and a seal element 369 is disposed in each groove 367. In use, the seal elements 367 provide a seal between the second housing portion 307B and the outer housing 322.

One or more axial port 371 (two ports 371 are shown in section in FIG. 14) is provided in the collar 365, each port 371 receiving a nozzle 319. In the illustrated embodiment, the axial port 357 is circular.

A radially extending boss 373 is provided on an outer surface of the second housing portion 307B, the boss 373 providing a male end portion of the second housing portion 307B for engaging the female end portion of the first housing portion 307A.

In this embodiment, the valve assembly 303 comprises a first annular piston 321 disposed at a downstream or downhole location relative to the lateral fluid ports 311A and a second annular piston 323 disposed at an upstream or uphole location relative to the lateral fluid ports 311B.

The first piston 321 is disposed in a first recess 325 formed between the first housing portion 307A and the mandrel 318 and the second piston 323 is disposed in a second recess 327 formed between the second housing portion 307B and the mandrel 318.

Chamber 329 is interposed between a lower end face 331 of the first piston 321 and the inward flange or lip 347 of first housing portion 307A and communicates with fluid pressure Pa' downstream of the nozzles 315. An upper end face 333 of the first piston 321, which in the illustrated embodiment is angled, communicates with fluid pressure Pb' upstream of the nozzles 319.

Chamber 335 is interposed between an upper end face 337 of the second piston 323 and the inwardly directed flange or lip 361 of the second housing portion 307B and communicates with fluid pressure Pc' uphole of nozzles 319. A lower end face 339 of the second piston 323 communicates with fluid pressure Pd' downhole of the nozzles 319.

A flange 341 extends radially inwards from the housing 307 at a position opposite the lateral fluid port 311. The flange 341 forms an abutment for the pistons 321, 323. As can be seen from the figures, in this embodiment the flange 341 comprises a separate component adapted to be coupled to the housing 307.

In use, the pistons 321, 323 are actuable to move the valve assembly 303 from an open configuration (as shown in FIG. 14) to a closed configuration (as shown in FIG. 15) by back pressure which may be controlled by manipulating the fluid flow in the annulus 334 and throughbore 309 using pumps at surface (not shown).

FIG. 14 shows the sliding sleeve device 312 in an open configuration, such as during a fluid injection operation. The fluid injection operation may for example comprise a water injection operation such as described above with reference to FIG. 6 and like numerals are used to describe like features and components. A shifting tool (not shown) may be run into the tool 310 and engaged with a recess 349 or shifting profile and operated to open the sleeve 348 to facilitate fluid egress out of the tool 310 and into the formation zone FZ (shown in FIGS. 3 and 4). In the configuration shown in FIG. 14, the sleeve 348 is therefore shown in the open position while the valve arrangement 3203 is still in the open configuration.

During the injection operation, fluid (such as water) is directed through the throughbore 324 and radially outwards through the open port 320. As can be seen from FIG. 14, a portion of the fluid is diverted in a downhole direction (to the right as shown in the figures) through the first nozzle assembly 313 while another portion of the fluid is diverted in an uphole direction (to the left as shown in the figures) through the second nozzle assembly 317. The nozzle assemblies 313, 317 are configured to alter the fluid dynamics of the fluid flow, such that erosion which may otherwise occur (in particular as a result of the diversion of the fluid flow by substantially 90 degrees) is mitigated, or eliminated. For example, the flow dynamics may be altered such that the location at which erosion may occur is preferentially located downstream of the nozzle assemblies 313, 317.

FIG. 15 shows the sliding sleeve device 312 in a shut-in configuration. In the configuration shown in FIG. 15, the sleeve 348 is closed and the valve arrangement 303 is in the closed configuration. When it is desired to shut-in the device 312, the flow of fluid in the annulus 334 is manipulated from surface or by other means, such that a back pressure acts on the lower end face 331 of the first piston 321 and the upper end face 333 of the second piston 323, urging the pistons 321, 323 into engagement with the flange 341 and isolating the throughbore 324 from the housing throughbore 309. Fluid communication through the throughbore 309 is maintained.

Referring now to FIGS. 17 to 20, there is shown a sliding sleeve device 412 of a downhole tool 410 according to another embodiment of the present invention. The sliding sleeve device 412 may be used as the sliding sleeve device 12 described above and, where applicable, like reference numerals incremented by 400 have been used to designate like components. However, it will be recognised that some or all of the features of the sliding sleeve device 412 may be used in any other sleeve device, such as the second sliding sleeve device 50, third sliding sleeve device 66, fourth sliding sleeve device 80 or fifth sliding sleeve device 94 described above or other flow control apparatus.

The sliding sleeve device 412 is substantially identical to the sliding sleeve device 312 with the exception that the sliding sleeve device 412 does not comprise nozzles. Instead, the axial ports 447 are in the form of circumferentially spaced slots.

As with the sliding sleeve device 312, the sliding sleeve device 412 comprises a mandrel 418 having one or more lateral flow passage 420 (two lateral flow passages 420 are shown in section in FIGS. 17 and 18) and an outer housing 422. The mandrel 418 comprises a tubular member defining an axial throughbore 424. An annulus 434 is defined between the mandrel 418 and the outer housing 422. A sleeve 448 is slidably disposed within the mandrel 418 and, in use, the sleeve 448 is used to open and close the lateral flow passage or passages 420 to selectively permit access between the axial flow passage/annulus 434 and the axial throughbore 424.

In the embodiment shown in FIGS. 17 to 20, the sliding sleeve device 312 is provided with a flow restrictor 401 and a valve assembly 403, which in the illustrated embodiment form part of an insert assembly 405 configured for location in the annulus 434.

The insert assembly 405 comprises a tubular housing 407. In this embodiment, the tubular housing 407 is modular, having a first, downhole, housing portion 407A and a second, uphole, housing portion 407A configured to be coupled together. The first housing portion 407A, the second housing portion 407B and the outer housing 422 together define a throughbore 409 or secondary axial flow passage.

The first housing portion 407A is generally tubular in construction and is provided with one or more lateral ports 411A. In the illustrated embodiment, eight circumferentially spaced lateral ports 411A are provided in the first housing portion 407A, two of which are shown in section in FIG. 14. The lateral ports 411A are angled in a downhole direction so as to direct fluid flow in a downhole direction, this beneficially assisting in mitigating or eliminating erosion which may otherwise occur due to the change of direction of fluid exiting the lateral ports 411A. A radially inwardly directed flange or lip 445 is provided at a downhole end of the first housing portion 407A. The flange 445 spaces the first housing portion 407A from the mandrel 418.

One or more axial ports 447 is provided through the flange 445 and provide access to a downhole chamber 429 of valve assembly 403.

A collar 451 is provided at the downhole end of the first housing portion 407*a* and engages the outer housing 422. One or more seal groove 453 is disposed in the outer surface of the collar 451 (two seal grooves 453 are shown) and a seal element 455 is disposed in each groove 453. In use, the seal elements 455 provide a seal between the first housing portion 407A and the outer housing 422.

One or more axial port 457 (two ports 457 are shown in section in FIG. 17)—which as described above are in the form of circumferentially arranged slots—is provided in the collar 451.

A recess 459 is provided in an inner surface of the first housing portion 407A at its uphole end, the recess 459 providing a female end portion of the first housing portion 407A for engaging the second housing portion 407B.

The second housing portion 407B is generally tubular in construction and is provided with one or more lateral ports 411B. In the illustrated embodiment, eight circumferentially spaced lateral ports 411B are provided in the first housing portion 407B, two of which are shown in section in FIG. 17. The lateral ports 411B are angled in an uphole direction so as to direct fluid flow in an uphole direction, this beneficially assisting in mitigating or eliminating erosion which may otherwise occur due to the change of direction of fluid exiting the lateral ports 411B. A radially inwardly directed flange or lip 461 is provided at an uphole end of the second housing portion 407B. The flange 461 spaces the second housing portion 407B from the mandrel 418. One or more axial port 463 is provided through the flange 461 and provides access to an uphole chamber 435 of valve assembly 403.

A collar 465 is provided at the uphole end of the second housing portion 407B and engages the outer housing 422. One or more seal groove 467 is disposed in the outer surface of the collar 465 (two seal grooves 467 are shown) and a seal element 469 is disposed in each groove 467. In use, the seal elements 467 provide a seal between the second housing portion 407B and the outer housing 422.

One or more axial port 471 (two ports 471 are shown in section in FIG. 17)—which in the illustrated embodiment—are in the form of circumferentially arranged slots—is provided in the collar 465.

A radially extending boss 473 is provided on an outer surface of the second housing portion 407B, the boss 473 providing a male end portion of the second housing portion 407B for engaging the female end portion of the first housing portion 407A.

In this embodiment, the valve assembly 403 comprises a first annular piston 421 disposed at a downstream or downhole location relative to the lateral fluid ports 411A and a second annular piston 423 disposed at an upstream or uphole location relative to the lateral fluid ports 411B.

The first piston 421 is disposed in a first recess 425 formed between the first housing portion 407A and the mandrel 418 and the second piston 423 is disposed in a second recess 427 formed between the second housing portion 407B and the mandrel 418.

Chamber 429 is interposed between a lower end face 431 of the first piston 421 and the inward flange or lip 447 of first housing portion 407A and communicates with fluid pressure Pa" downstream of the ports 471. An upper end face 433 of the first piston 421, which in the illustrated embodiment is angled, communicates with fluid pressure Pb" upstream of the ports 457.

Chamber 435 is interposed between an upper end face 337 of the second piston 423 and the inwardly directed flange or lip 461 of the second housing portion 407B and communicates with fluid pressure Pc" upstream of ports 471. A lower end face 439 of the second piston 423 communicates with fluid pressure Pd" upstream of the ports 471.

A flange 441 extends radially inwards from the housing 407 at a position opposite the lateral fluid port 411. The flange 441 forms an abutment for the pistons 421, 423. As can be seen from the figures, in this embodiment the flange 441 comprises a separate component adapted to be coupled to the housing 407.

Figure 17:
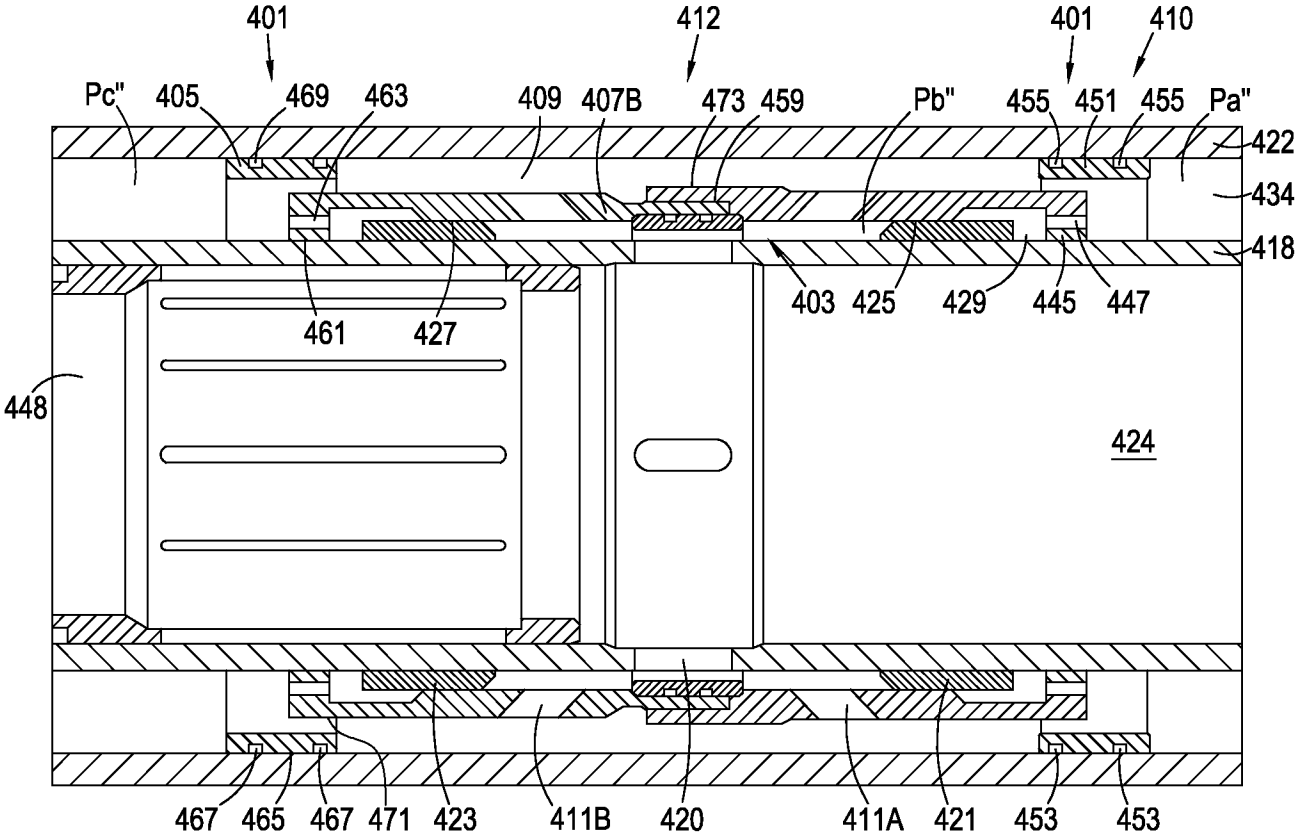
FIG. 17 is a longitudinal section view of a downhole tool portion of a downhole tool according to another embodiment of the present invention, in a first configuration.
Figure 18:
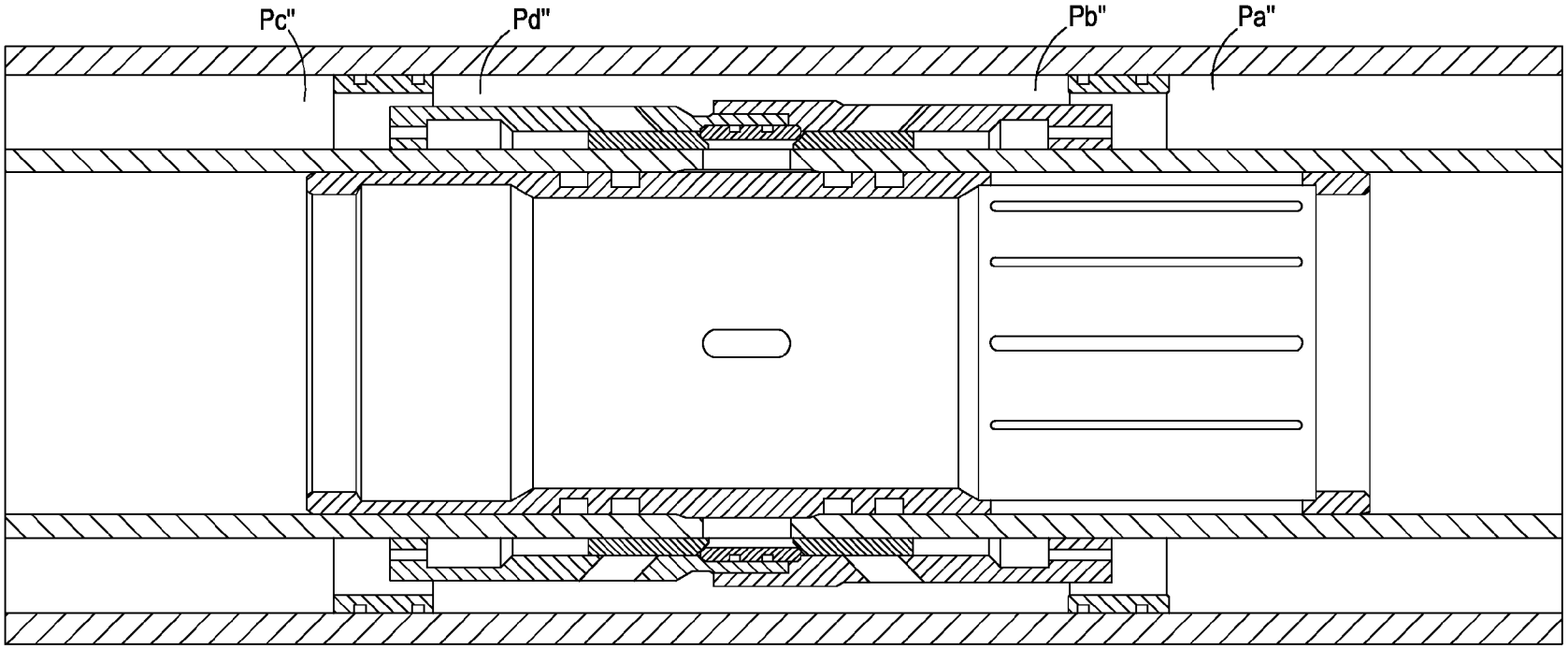
FIG. 18 is a longitudinal section view of the downhole tool portion shown in FIG. 17, in a second configuration.
Figure 19:
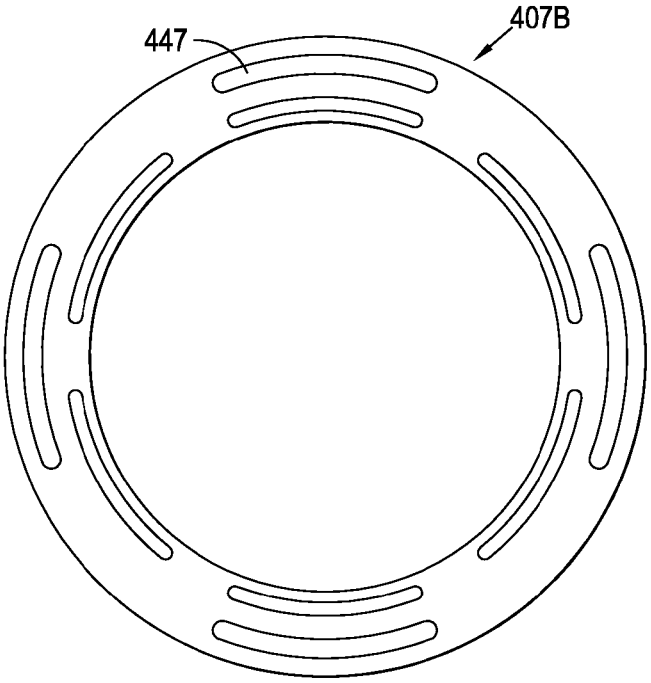
FIG. 19 is an end view of a housing portion of the downhole tool portion shown in FIGS. 17 and 18.
Figure 20:
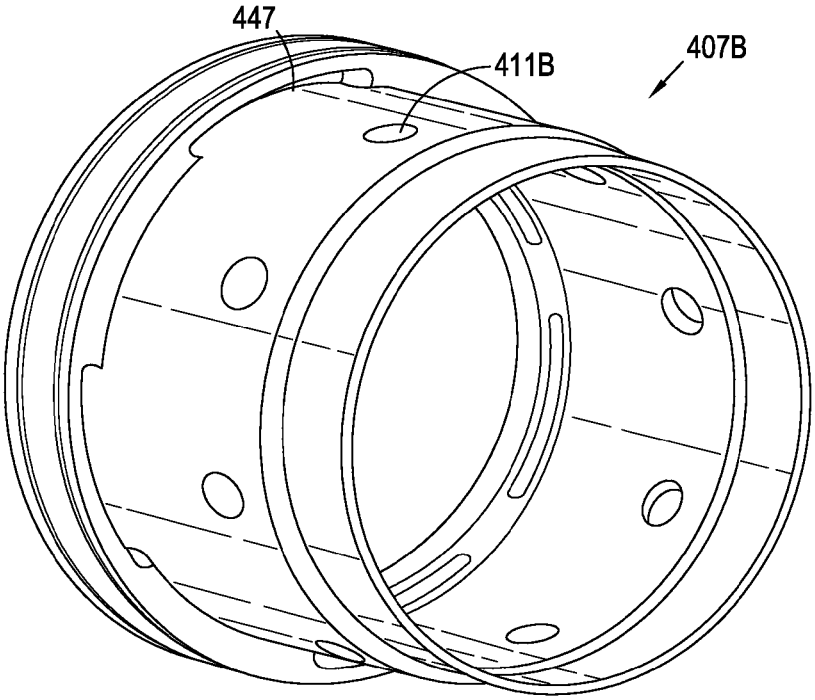
FIG. 20 is a perspective view of the housing portion of the downhole tool portion shown in FIG. 19.
Figure 21:
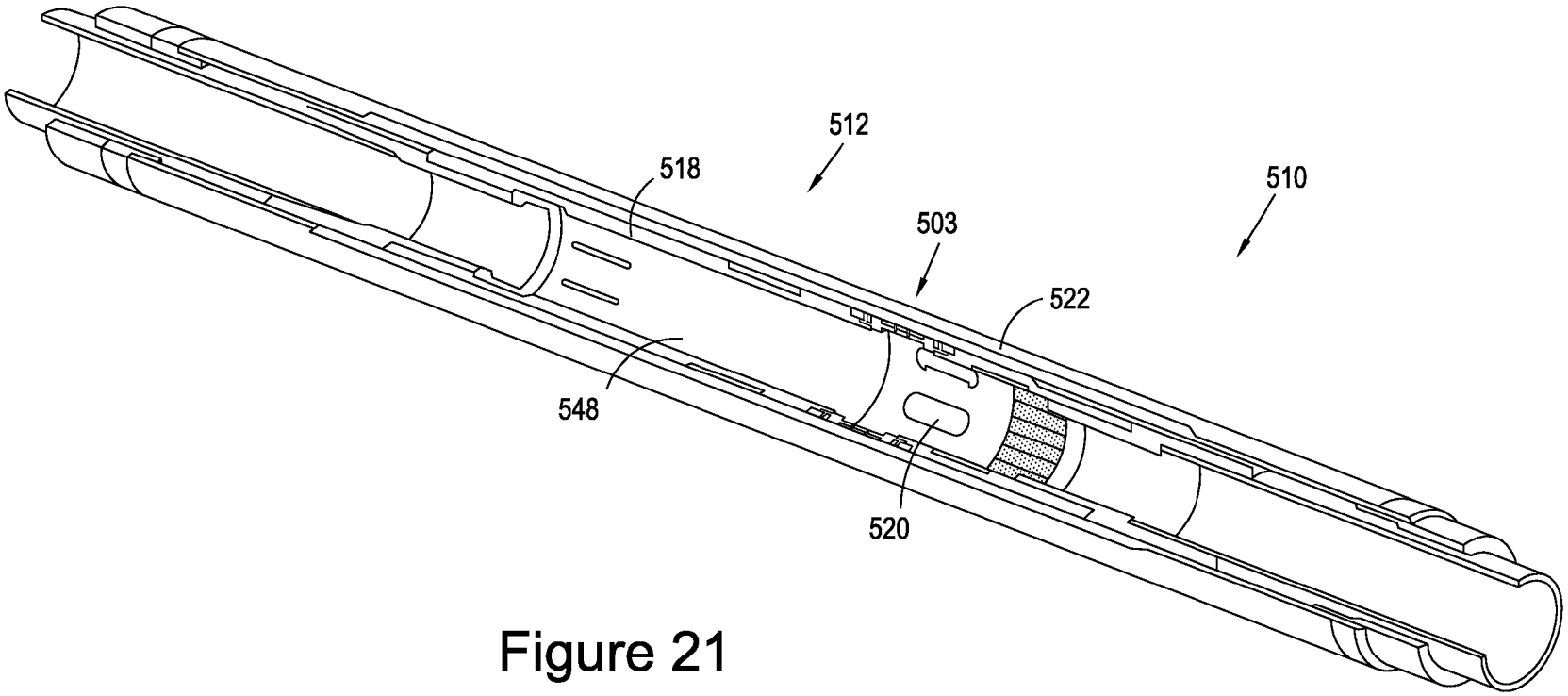
FIG. 21 is a perspective view of a downhole tool portion of a downhole tool according to another embodiment of the present invention, in a first configuration.
Figure 22:
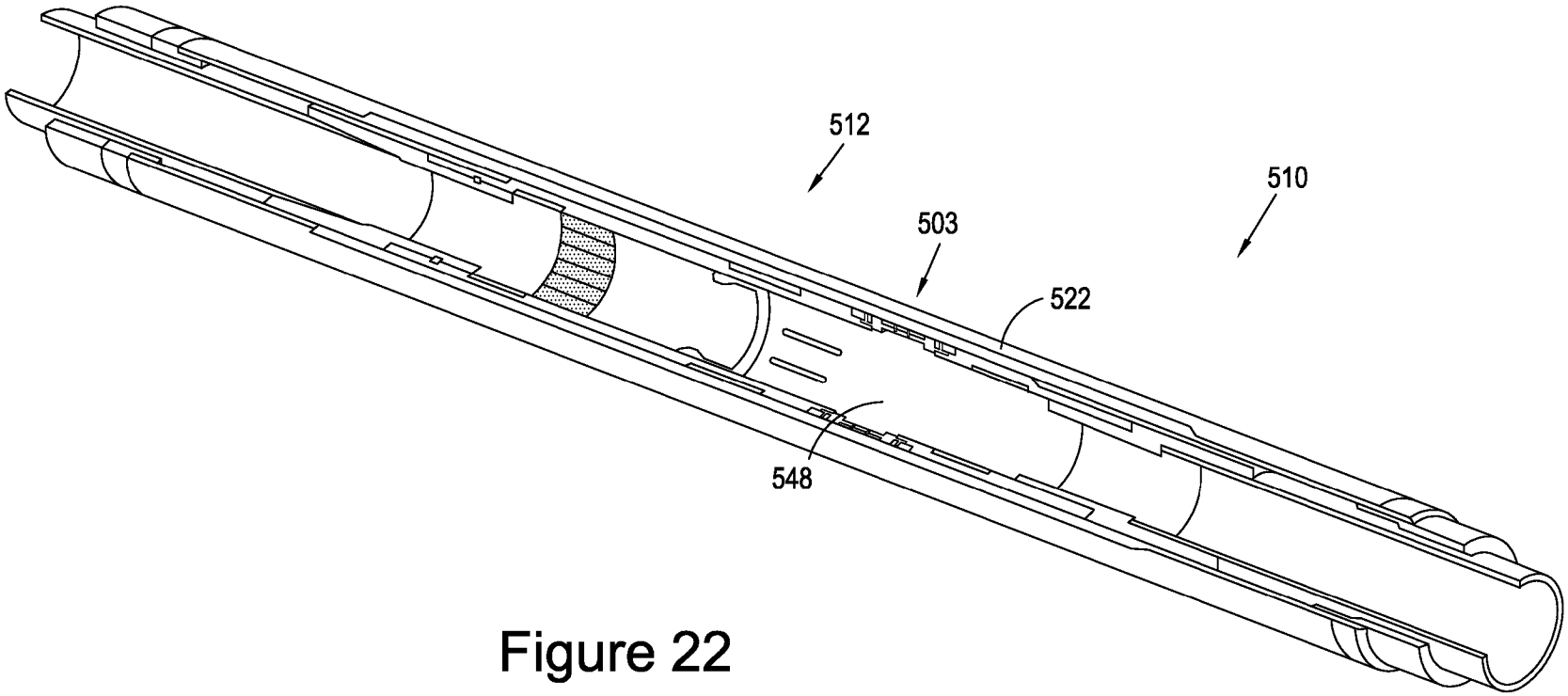
FIG. 22 is a perspective view of the downhole tool portion of the downhole tool shown in FIG. 23 is a longitudinal cut-away view of the downhole tool portion shown in FIGS. 21 and 22, shown in the first configuration.
Figure 23:
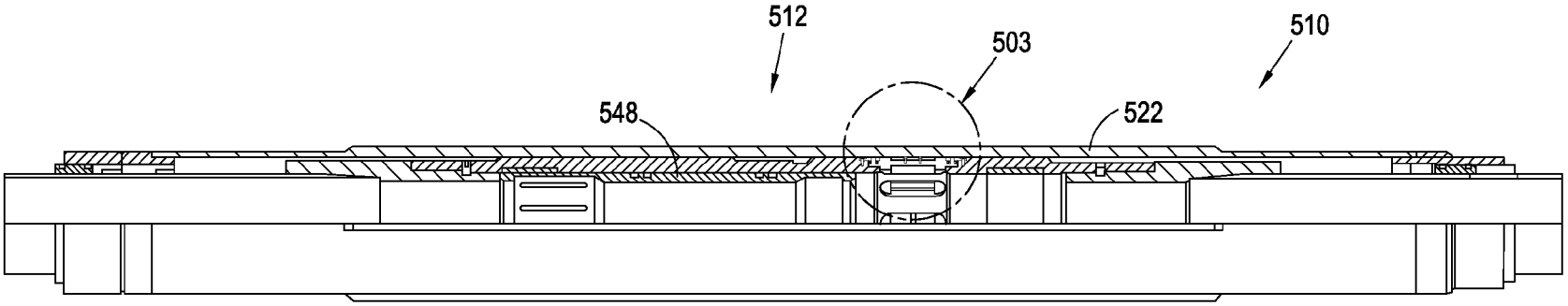
Figure 24:
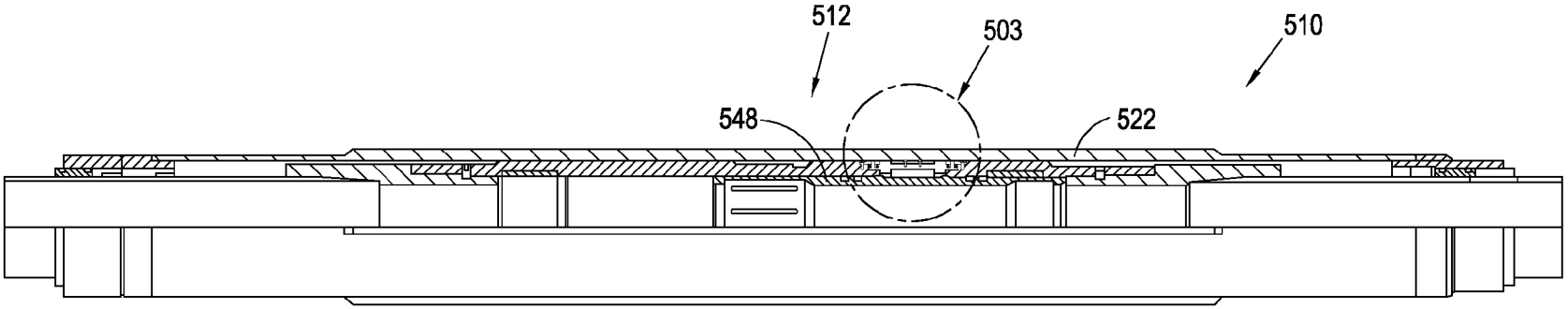
FIG. 24 is a longitudinal cut-away view of the downhole tool portion shown in FIGS. 21 and 22, shown in the second configuration.

In use, the pistons 421, 423 are actuable to move the valve assembly 403 from an open configuration (as shown in FIG. 17) to a closed configuration (as shown in FIG. 18) by back pressure which may be controlled by manipulating the fluid flow in the annulus 434 and throughbore 409 using pumps at surface (not shown).

FIG. 17 shows the sliding sleeve device 412 in an open configuration, such as during a fluid injection operation. The fluid injection operation may for example comprise a water injection operation such as described above with reference to FIG. 6 and like numerals are used to describe like features and components. A shifting tool (not shown) may be run into the tool 410 and engaged with a recess 449 or shifting profile and operated to open the sleeve 448 to facilitate fluid egress out of the tool 410 and into the formation zone FZ (shown in FIGS. 3 and 4). In the configuration shown in FIG. 17, the sleeve 448 is therefore shown in the open position while the valve arrangement 403 is still in the open configuration.

During the injection operation, fluid (such as water) is directed through the throughbore 424 and radially outwards through the open port 420. As can be seen from FIG. 17, a portion of the fluid is diverted in a downhole direction (to the right as shown in the figures) through the ports 457 while another portion of the fluid is diverted in an uphole direction (to the left as shown in the figures) through the ports 471. The ports 457, 471 are configured to alter the fluid dynamics of the fluid flow, such that erosion which may otherwise occur (in particular as a result of the diversion of the fluid flow by substantially 90 degrees) is mitigated, or eliminated. For example, the flow dynamics may be altered such that the location at which erosion may occur is preferentially located downstream of the ports 457, 471.

FIG. 18 shows the sliding sleeve device 412 in a shut-in configuration. In the configuration shown in FIG. 18, the sleeve 448 is closed and the valve arrangement 403 is in the closed configuration. When it is desired to shut-in the device 412, the flow of fluid in the annulus 434 is manipulated from surface or by other means, such that a back pressure acts on the lower end face 431 of the first piston 421 and the upper end face 433 of the second piston 423, urging the pistons 421, 423 into engagement with the flange 441 and isolating the throughbore 424 from the housing throughbore 409. Fluid communication through the throughbore 409 is maintained.

Referring now to FIGS. 21 to 31, there is shown a sliding sleeve device 512 of a downhole tool 510 according to another embodiment of the present invention. The sliding sleeve device 512 may be used as the sliding sleeve device 12 described above and, where applicable, like reference numerals incremented by 500 have been used to designate like components. However, it will be recognised that some or all of the features of the sliding sleeve device 512 may be used in any other sleeve device, such as the second sliding sleeve device 50, third sliding sleeve device 66, fourth sliding sleeve device 80 or fifth sliding sleeve device 94 described above or other flow control apparatus.

The sliding sleeve device 512 comprises a mandrel 518 having one or more lateral flow passage 520 and an outer housing 522. The mandrel 518 comprises a tubular member defining an axial throughbore 524. An annulus 534 is defined between the mandrel 518 and the outer housing 522. A sleeve 548 is slidably disposed within the mandrel 518 and, in use, the sleeve 548 is used to open and close the lateral flow passage or passages 520 to selectively permit access between the axial flow passage/annulus 534 and the axial throughbore 524.

In this embodiment, the sleeve 548 also comprises a lateral flow port 574. Seal grooves 579 are formed in the outer surface of the sleeve 548, each seal groove 579 receiving a seal element 581 in the form of an o-ring seal. In use, the seals 581 straddle the lateral flow port 574 and prevent leakage of fluid between the sleeve 548 and the mandrel 518.

In this embodiment, the sliding sleeve device 512 is also provided with a valve assembly 503, which will be described further below.

The valve assembly 503 comprises a plurality of valve members 583 disposed radially opposite to the lateral fluid ports 520 of the mandrel 518 and which are radially moveable so as to define an open configuration which permits fluid passage through the lateral fluid ports 520 and a closed or shut-in configuration which prevents fluid passage through the lateral fluid ports 520.

Figure 25:
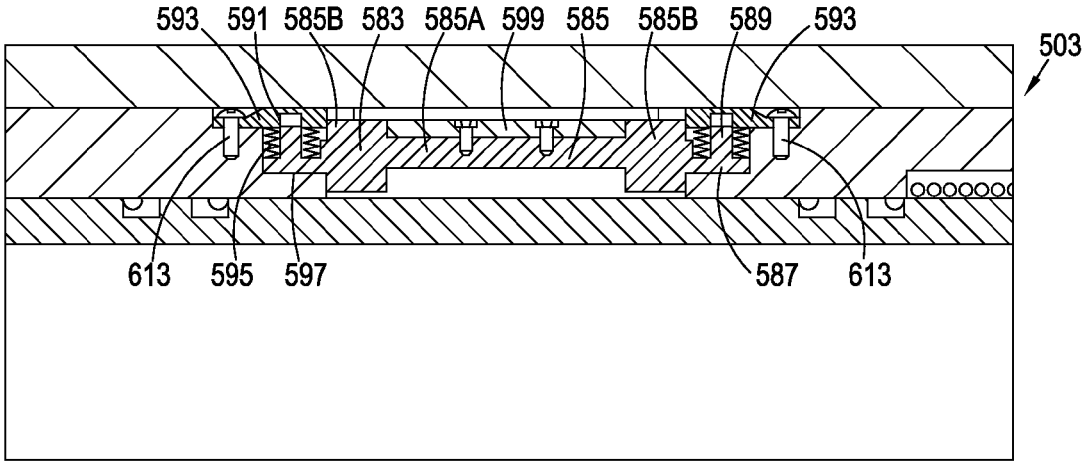
FIG. 25 is an enlarged view of the highlighted region of FIG. 23.
Figure 26:
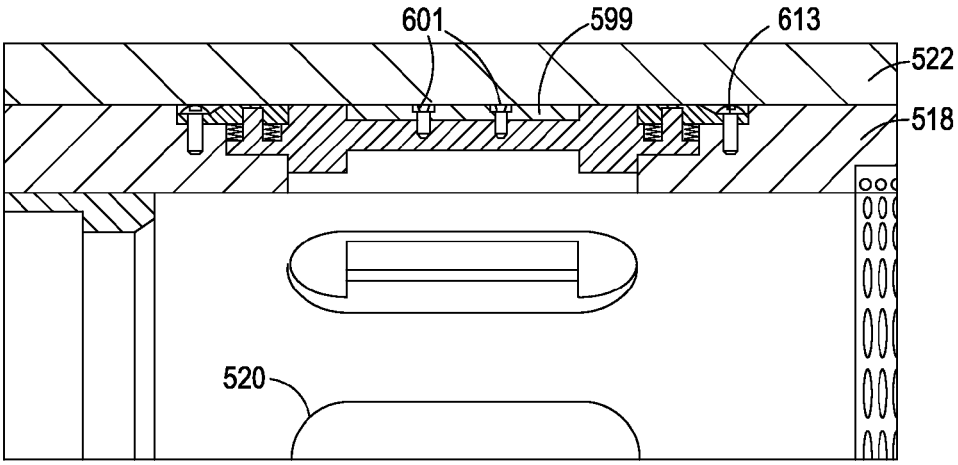
FIG. 26 is an enlarged view of the highlighted region of FIG. 24.

FIGS. 25 and 26 show enlarged views of part of the sliding sleeve device 512, showing the valve assembly 503 in more detail. FIG. 25 shows the valve assembly 503 in the closed or shut-in configuration. FIG. 26 shows the valve assembly 503 in the open configuration. As shown in FIGS. 25 and 26, the valve member 583 comprises a body 585 having a central body portion 585B and two end portions 585B. In the illustrated embodiment, the end portions 585B are hemi-cylindrical in shape. Lugs 587 extend axially from the outer surface of each end portion 585B. A radially extending pin 589 is formed on each lug 587 and is adapted to slidingly engage a corresponding hole 591 in a mounting bracket 593. A spring 595, in the illustrated embodiment a coil spring, is disposed around each pin and is interposed between the valve member and the mounting bracket 593.

The valve assembly 503 is disposed in a recess 597 provided in an outer surface of the mandrel 518.

Figure 27:
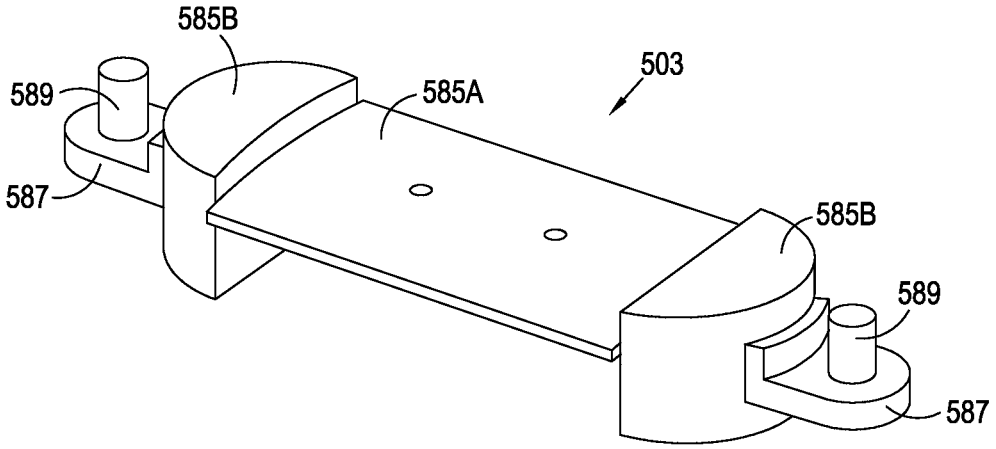
FIG. 27 is a perspective view of a valve member
Figure 28:
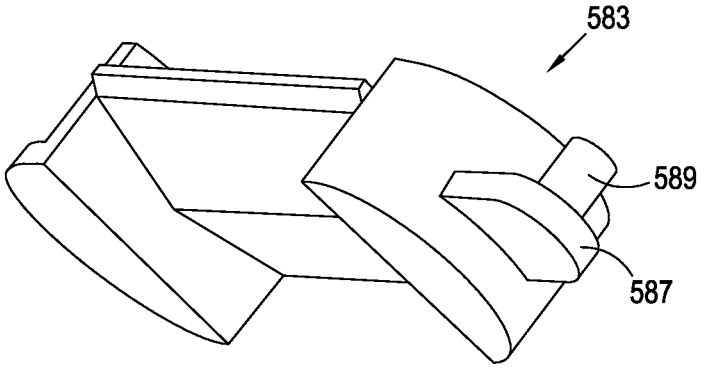
FIG. 28 is another perspective view of the valve member shown in FIG. 27.

FIGS. 27 and 28 show perspective views of an exemplary valve member 583 for use in the valve assembly 503. As shown most clearly in FIG. 27, the radially outward surface of the valve member 583 is recessed relative to the end portions 585B and receives a separate deflection plate 599 which is secured to the central body portion 585A by fasteners 601, although any suitable coupling means may be used, where appropriate. The deflection plate 599 is formed of a hard material, such as tungsten carbide.

As shown most clearly in FIG. 28, the radially inward surface of the valve member 583 is angled to beneficially define deflection surfaces for fluid and mitigate erosional effects.

Figure 29:
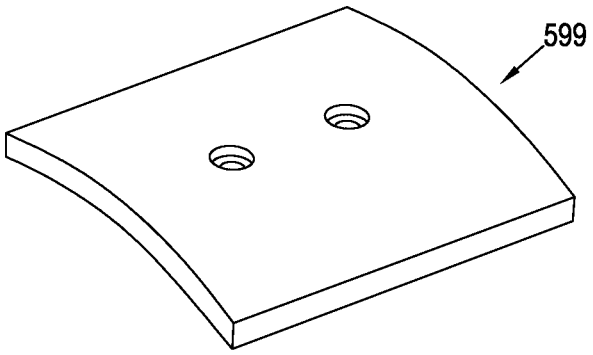
FIG. 29 is a perspective view of a deflector plate.
Figure 30:
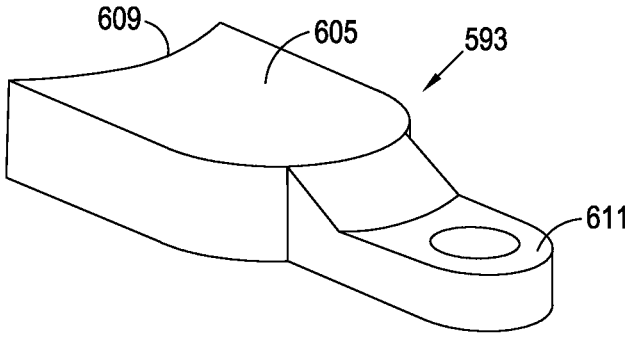
FIG. 30 is a perspective view of a mounting bracket.
Figure 31:
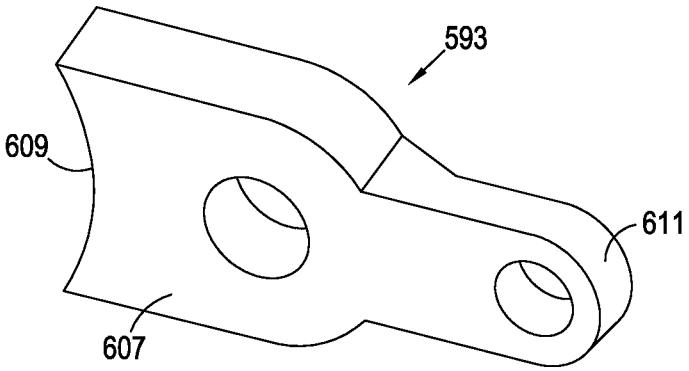
FIG. 31 is another perspective view of the mounting bracket shown in FIG. 30.

FIGS. 29 to 31 show enlarged perspective views of the deflection plate 599, and mounting brackets 593 of the valve assembly 503 and FIGS. 30 and 31 are perspective views of one of the mounting brackets 593 of the valve assembly 503.

As shown in FIGS. 30 and 31, the mounting bracket 593 comprises a body portion 603 having an upper surface 605, a lower surface 607 and an end surface 609 shaped for engagement with the hemi-cylindrical end of the valve member 583. The mounting bracket 593 also comprises a lug 611 for receiving a fastener 613 to secure the mounting bracket to the mandrel 518. In use, the valve member 583 is biased by the springs 595 in a normally closed configuration (as shown in FIG. 25). The valve member 583 is moved from the closed configuration to the open configuration by fluid pressure, such as the pressure of fluid being injected into the formation zone FZ as shown in FIG. 6, the fluid pressure compressing the springs 565 and moving the valve member radially outwards. Fluid exiting through the ports is deflected by the deflection surfaces on the underside of the valve member 583. In the absence of the fluid pressure to retain the valve member 583 in the open configuration, the valve member 583 returns to the closed configuration. Fluid pressure or flow acting radially inwards acts to maintain the valve member 583 in the shut-in configuration.

Embodiments of the present invention may thus provide a downhole tool and method for controlling fluid flow into and/or from a formation zone, the downhole tool comprising a sliding sleeve device disposed between, and forming a fluid coupling between a first screen and a second screen, the sliding sleeve device configured to provide axial fluid communication between the screens and to provide selective lateral passage of fluid through the screens into a throughbore of the downhole tool.

It should be understood that the embodiments described herein are merely exemplary and that various modifications may be made thereto without departing from the scope of the invention.

It will be recognised that while the terms uphole and downhole are used, the tool 10 may be used in any orientation, where appropriate.

While the illustrated embodiment shows a single tool 10 being used to control fluid flow to and from a single formation zone, it will be recognised that a plurality of tools 10 may be provided, each operable to control fluid flow from one or more formation zone or zones.

While the illustrated embodiments have been described with reference to a frac-pack operation, it will be understood that embodiments of the invention may alternatively have application in a gravel pack application.

While the illustrated embodiments describe fluid being directed into a formation towards the heel or uphole end of the well and re-entering towards the downhole end or toe of the well, it will be understood that embodiments of the invention may alternatively involve fluid being directed into a formation towards the downhole end of the well and re-entering at the uphole end.

It will be recognised that the valve assembly 503 may be used in other sliding sleeve devices other than those described. The valve assembly may comprise a sub-assembly.

The invention claimed is:

1. A downhole tool comprising:

a screen comprising a first tubular disposed around a second tubular, an annulus provided within the screen between the first tubular and the second tubular, wherein the first tubular is a permeable tubular member of the screen and the second tubular is a solid tubular base pipe of the screen, the second tubular being non-permeable to lateral passage of fluid; and a flow control apparatus or arrangement comprising a sleeve, the sleeve comprising a mandrel and a housing and an annulus between the mandrel and the housing, wherein the flow control apparatus or arrangement is configured to selectively prevent passage of fluid outwards through the screen by selectively preventing fluid communication between a throughbore of the downhole tool and the annulus between the first tubular member and the second tubular member; and/or wherein the flow control apparatus or arrangement is configured to selectively prevent passage of fluid into the throughbore of the downhole tool by selectively preventing fluid communication between the annulus and the throughbore.

2. The tool of claim 1, wherein the flow control apparatus or arrangement is configured to provide a fluid flow path for directing the fluid between the annulus and a port.

3. The tool of claim 1, wherein the tool comprises a plurality of the screens.

4. The tool of claim 3, wherein the flow control apparatus or arrangement is configured to provide fluid communication between the annuli of adjacent screens of said plurality of screens.

5. The tool of claim 3, wherein the flow control apparatus or arrangement is configured to provide a fluid flow path for directing the fluid disposed in the annuli of said plurality of screens, to a port.

6. The tool of claim 3, wherein the flow control apparatus or arrangement is coupled between adjacent screens of said plurality of screens.

7. The tool of claim 1, wherein the flow control apparatus or arrangement comprises a coupling and the screen is coupled to the flow control apparatus or arrangement.

8. The tool of claim 1, wherein the sleeve comprises a sliding sleeve member.

9. The tool of claim 1, comprising a flow restrictor.

10. The tool of claim 9, wherein the flow restrictor is configured or positioned to alter the pressure of a fluid flow at a selected location or locations in the downhole tool.

11. The tool of claim 9, wherein the flow restrictor is disposed in a sleeve.

12. The tool of claim 9, wherein the flow restrictor comprises a nozzle arrangement.

13. The tool of claim 1, comprising a valve arrangement configurable between an open configuration and a closed configuration.

14. The tool of claim 13, wherein the valve arrangement comprises at least one closure member.

15. The tool of claim 14, wherein the valve arrangement is configured to move the at least one closure member axially to move the valve arrangement between the open configuration and the closed configuration.

16. The tool of claim 14, wherein the valve arrangement is configured to move the at least one closure member radially to move the valve arrangement between the open configuration and the closed configuration.

17. The tool of claim 14, wherein the at least one closure member comprises a fluid actuated piston.

18. The tool of claim 13, wherein the valve arrangement comprises a fluid conduit or gallery for permitting axial passage of fluid through an annulus of the downhole tool when the valve arrangement is configured in the closed configuration.

19. The tool of claim 1, wherein the mandrel of said sleeve is configured to be coupled at an uphole end to the second tubular of the screen and the housing of said sleeve is configured to be coupled at an uphole end to an end ring of the screen.

20. A method for controlling fluid flow into and/or from a formation, the method comprising:

providing a downhole tool comprising a screen and a flow control apparatus or arrangement, wherein the screen comprises a first tubular member disposed around a second tubular member, and an annulus is provided within the screen between the first tubular member and the second tubular member, wherein the first tubular is a permeable tubular member of the screen and the second tubular is a solid tubular base pipe of the screen, the second tubular being non-permeable to lateral passage of fluid, wherein the flow control apparatus or arrangement comprises a sleeve, the sleeve comprising a mandrel and a housing and an annulus between the mandrel and the housing; and configuring the flow control apparatus or arrangement of the downhole tool to selectively prevent passage of fluid through the screen of the downhole tool by selectively preventing fluid communication between a throughbore of the downhole tool and the annulus between the first tubular member and the second tubular member; and/or by selectively preventing passage of fluid into the throughbore of the downhole tool by selectively preventing fluid communication between the annulus and the throughbore.

21. A downhole tool comprising:

a screen comprising a first tubular disposed around a second tubular, an annulus provided within the screen between the first tubular and the second tubular, wherein the first tubular is a permeable tubular member of the screen and the second tubular is a solid tubular base pipe of the screen, the second tubular being non-permeable to lateral passage of fluid;

a flow control apparatus or arrangement, wherein the flow control apparatus or arrangement is configured to selectively prevent passage of fluid outwards through the screen by selectively preventing fluid communication between a throughbore of the downhole tool and the annulus between the first tubular member and the second tubular member; and/or wherein the flow control apparatus or arrangement is configured to selectively prevent passage of fluid into the throughbore of the downhole tool by selectively preventing fluid communication between the annulus and the throughbore; and a valve arrangement configurable between an open configuration and a closed configuration, wherein the valve arrangement comprises at least one closure member, and wherein the valve arrangement is configured to move the at least one closure member radially to move the valve arrangement between the open configuration and the closed configuration.

22. A method for controlling fluid flow into and/or from a formation, the method comprising:

providing a downhole tool comprising a screen; a flow control apparatus or arrangement; and a valve arrangement configurable between an open configuration and a closed configuration, wherein the screen comprises a first tubular member disposed around a second tubular member, and an annulus is provided within the screen between the first tubular member and the second tubular member, wherein the first tubular is a permeable tubular member of the screen and the second tubular is a solid tubular base pipe of the screen, the second tubular being non-permeable to lateral passage of fluid, and wherein the valve arrangement comprises at least one closure member, the valve arrangement configured to move the at least one closure member radially to move the valve arrangement between the open configuration and the closed configuration; and configuring the flow control apparatus or arrangement of the downhole tool to selectively prevent passage of fluid through the screen of the downhole tool by selectively preventing fluid communication between a throughbore of the downhole tool and the annulus between the first tubular member and the second tubular member; and/or by selectively preventing passage of fluid into the throughbore of the downhole tool by selectively preventing fluid communication between the annulus and the throughbore.

* * * * *